US005591568A

United States Patent [19]

Bagchi et al.

[11] Patent Number: 5,591,568

[45] Date of Patent: Jan. 7, 1997

[54] HIGH DYE STABILITY, HIGH ACTIVITY, LOW STAIN AND LOW VISCOSITY SMALL PARTICLE YELLOW DISPERSION MELT FOR COLOR PAPER AND OTHER PHOTOGRAPHIC SYSTEMS

[75] Inventors: Pranab Bagchi, Webster; James L. Edwards, Rochester, both of N.Y.; Danuta Gibson, Watford, United Kingdom; Thomas A. Rosiek, Honeoye Falls, N.Y.; Brian Thomas, Fairport, N.Y.; Vincent J. Flow, III, Kendall, N.Y.

[73] Assignee: Eastman Kodak Company, Rochester, N.Y.

[21] Appl. No.: 301,745

[22] Filed: Sep. 6, 1994

Related U.S. Application Data

[62] Division of Ser. No. 627,154, Dec. 13, 1990, Pat. No. 5,358,831.

[51] Int. Cl.[6] ..... G03C 7/388; G03C 1/38

[52] U.S. Cl. ..... 430/449; 430/546; 430/630; 430/631; 430/638; 430/935; 430/545; 252/306; 252/314; 252/315.1; 252/353; 252/356

[58] Field of Search ..... 430/516, 449, 430/630, 631, 638, 935, 545; 252/306, 308, 314, 315.1, 353, 356

[56] References Cited

U.S. PATENT DOCUMENTS

| | | | |
|---|---|---|---|
| 3,960,570 | 6/1976 | Oishi et al. | 430/551 |
| 4,140,530 | 2/1979 | Trunley et al. | 430/493 |
| 4,284,709 | 8/1981 | Tomka | 430/377 |
| 4,379,836 | 4/1983 | Schnoring et al. | 430/377 |

(List continued on next page.)

FOREIGN PATENT DOCUMENTS

| | | | |
|---|---|---|---|
| 672440 | 11/1965 | Belgium | 430/631 |
| 1153159 | 8/1963 | Germany | 430/630 |
| 0015731 | 2/1979 | Japan | 430/630 |

OTHER PUBLICATIONS

Research Disclosure 10228, Oct. 1972.

*Primary Examiner*—Lee C. Wright
*Attorney, Agent, or Firm*—Paul A. Leipold

[57] ABSTRACT

This invention provides composition and method to overcome the very high viscosity of prior small-particle dispersions when admixed with gelatin in aqueous solution for coating a photographic film element.

The invention is generally accomplished by the utilization of a second surfactant in the melt formulated by the admixture of the small-particle dispersion and the gelatin solution. The surfactants of this invention, that is, utilized to control the rheology of such said melts, have the following general structure:

(SI-1)

(SI-2)

wherein n=5 to 20 and x=1 to 4.

15 Claims, 8 Drawing Sheets

U.S. PATENT DOCUMENTS

| | | | |
|---|---|---|---|
| 4,614,709 | 9/1986 | Sasaki et al. | 430/546 |
| 4,624,903 | 11/1986 | Simons | 430/14 |
| 4,668,611 | 5/1987 | Nakamura | 430/507 |
| 4,684,606 | 8/1987 | Krishnamurthy | 430/546 |
| 4,766,061 | 8/1988 | Simons | 430/546 |
| 4,774,166 | 9/1988 | Sasaki et al. | 430/376 |
| 4,857,449 | 8/1989 | Ogawa et al. | 430/546 |
| 4,874,688 | 10/1989 | Ozawa et al. | 430/546 |
| 4,933,270 | 6/1990 | Bagchi | 430/546 |
| 4,957,857 | 9/1980 | Chari | 430/546 |
| 4,970,139 | 11/1990 | Bagchi et al. | 430/449 |
| 4,990,431 | 2/1991 | Bagchi et al. | 430/372 |
| 5,008,179 | 4/1991 | Chari et al. | 430/546 |
| 5,013,640 | 5/1991 | Bagchi et al. | 430/546 |
| 5,015,564 | 5/1991 | Chari | 430/546 |
| 5,087,554 | 2/1992 | Chari et al. | 430/546 |
| 5,089,380 | 2/1992 | Bagchi | 430/449 |
| 5,091,296 | 2/1992 | Bagchi et al. | 430/546 |
| 5,104,776 | 4/1992 | Bagchi et al. | 430/546 |
| 5,135,844 | 8/1992 | Bagchi et al. | 430/546 |
| 5,158,863 | 10/1992 | Bagchi et al. | 430/449 |
| 5,182,189 | 1/1993 | Bagchi et al. | 430/449 |
| 5,256,527 | 10/1993 | Chari et al. | 430/449 |
| 5,279,931 | 1/1994 | Bagchi et al. | 430/449 |

(PRIOR ART)

HIGH DYE STABILITY, HIGH ACTIVITY, LOW STAIN AND LOW VISCOSITY SMALL PARTICLE YELLOW DISPERSION MELT FOR COLOR PAPER AND OTHER PHOTOGRAPHIC SYSTEMS

This is a Divisional of application Ser. No. 627,154 filed Dec. 13, 1990 now U.S. Pat. No. 5,358,831.

FIELD OF THE INVENTION

This invention relates to the composition and method of formulation of very small-particle photographic dispersions in admixture with gelatin, generally called a melt, for the purpose of preparing photographic coating.

Prior Art

In the photographic arts it is common to utilize gelatin for the formation of photographically active elements for film production. In the formation of color films, couplers are utilized in gelatin layers for color formation. These layers are formed by laying down thin coatings of gelatinous aqueous dispersions of the coupler, along with a sensitized silver halide emulsion.

In formation of gelatinous dispersions of couplers, it has been known to utilize surfactants to aid in formation of stable dispersions. Generally coupler dispersions, suitable for use in photography, are prepared by milling operations that result in dispersions of couplers that range in particle diameters between 100 and 1000 nm.

It has also been known to precipitate hydrophobic components of photographic systems starting from a solution state to form a stable fine particle colloidal dispersion. This is generally achieved by dissolving the coupler in a water-miscible solvent aided by addition of base to ionize the coupler, addition of surfactant with subsequent precipitation of the photographic component by lowering the pH, or by shift in concentration of the two or more miscible solvents such that the photographic component is no longer soluble in the continuous phase and the precipitate is a fine colloidal dispersion.

In the United Kingdom Patent 1,193,349—Townsley et al discloses a process whereby a color coupler is dissolved in a mixture of water-miscible organic solvent and aqueous alkali. The solution of color coupler is then homogeneously mixed with an aqueous acid medium including a protective colloid. Thus, there is formed a dispersion of precipitated color coupler by shift of pH, and this dispersion of color coupler when mixed with a dispersion of an aqueous silver halide emulsion and coated on a support, forms a photographic element.

In an article in *Research Disclosure* 16468, December 1977, pages 75–80, entitled "Process for Preparing Stable Aqueous Dispersions of Certain Hydrophobic Materials" by W. J. Priest, a method of forming stable aqueous dispersions of hydrophobic photographic material was disclosed. The process of Priest involves the formation of an alkaline aqueous solution of an alkali soluble color-forming coupler compound in the presence of a colloid stabilizer or polymeric latex. The alkali solution is then made more acidic in order to precipitate the hydrophobic protonated color-forming coupler compounds. The droplets of color-forming coupler compounds are stabilized against excessive coagulation by adsorption of a colloid stabilizer.

U.S. Pat. No. 4,388,403—Helling et al discloses a process of preparation of dispersions of hydrophobic substances in water. In Helling et al the dispersions of hydrophobic substances in water are prepared by dissolving the hydrophobic substance together with an ionic polyaddition or condensation product in an organic, water-miscible solvent or a mixture of such a solvent with water, diluting the solution with water and removing the organic solvent. This process is a preparation that causes the particle formation by solvent shift of the solution. Helling et al suggests utilization of the process for preparation of photographic recording materials.

While systems using particles formed by precipitation of particles from solution have been somewhat successful and photographic components have been formed using such dispersions, it is not believed that such systems have been successfully commercialized. One difficulty in commercialization is that small particle dispersions when combined with the customary amount of gelatin form very high viscosity dispersions. While the viscosity can sometimes be reduced by utilization of conventional surfactants, the amount of surfactant required is very high, which leads to problems such as poor adhesion to the photographic support. It is also unsatisfactory because of the added cost of the increased amount of surfactant. It is further unsatisfactory in that high amounts of surfactant have resulted in undesirable effects in the film because of the interaction of the surfactant causing stains and color change of the formed dye and yellowing upon aging.

Therefore, there is a need for a way of forming and formulating small particle dispersions in gelatin at low viscosity and with low surfactant addition. Further, there is a need to lower the cost of commercial formation of small particle dispersions by lowering the quantity of surfactant required. There further is a need for surfactants that while lowering viscosity do not cause yellowing upon aging, particularly by reaction with magenta couplers.

The Invention

An object of the invention is to overcome the very high viscosity of prior small-particle dispersions when admixed with gelatin in aqueous solution for coating a photographic film element.

Another object is to form photographic materials with reduced yellowing caused by magenta coupler reaction with surfactant.

The invention is generally accomplished by the utilization of a second surfactant in the melt formulated by the admixture of the small-particle dispersion and the gelatin solution. The surfactants of this invention, that are utilized as the second surfactant to control the rheology of such said melts have the following general structures:

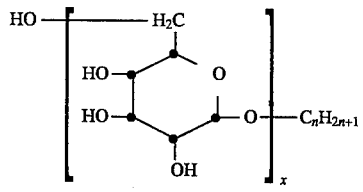

(SI-1)

-continued

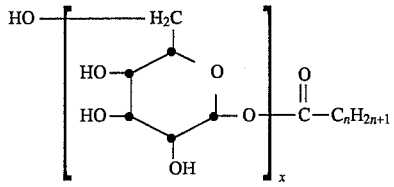

(SI-2)

wherein n=5 to 20 and x=1 to 4.

The preferred colloid particles of the photographic dispersion material of this invention have particle diameters between about 5 nm and 100 nm, preferably below 20 nm, and have been prepared by precipitation from solution by solvent and/or pH shift. The invention surfactant is present in an amount of about 10 to about 30 percent by weight of the coupler. The SI-1 and SI-2 surfactants may be utilized alone or as mixtures of SI-1 and SI-2 surfactants as the second surfactant.

The preferred method of preparation of such low viscosity melt constitutes the following steps:

1. Heat with stirring the concentrated small particle dispersion containing a first surfactant (10 to 16% by weight of coupler) to between 40° to 60° C.
2. Heat with stirring the gelatin solution (10 to 16% by weight of gelatin) to the same temperature as the coupler solution, containing the necessary amount of the second surfactant of this invention (SI-1) or (SI-2).
3. Add the gelatin solution to the coupler solution with agitation, to obtain the low viscosity gelatin melt.

MODES OF PRATICING THE INVENTION

The dispersion melt and the melt-forming process of the invention has numerous advantages over prior practices. The rheology control surfactant of the invention shows less yellowing in the magenta layer on keeping than other surfactants. The system allows less use of surfactant, this results in cost savings. The surfactant of the invention minimizes interacting with other ingredients of the photographic system to cause stains and color shifts of the formed dye. Another advantage is that it produces low viscosity dispersion melts of very fine particles formulated with conventional ratios of water, gelatin, and coupler so that conventional coating methods by slide hoppers (T. A. Russell U.S. Pat. No. 2,761,791) may be employed for producing multilayer photographic coatings. Since, in many cases, fine particle couplers are more efficient in producing dye density, less coupler can be used than when large particle coupler dispersions are utilized leading to cost savings.

Another advantage of the surfactants of the invention is that they do not cause yellowing upon aging particularly yellowing of the magenta couplers. Another advantage is that the surfactants are environmentally acceptable as they are formed from sugars.

Figure 1:
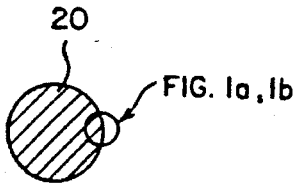
FIG. 1 (PRIOR ART)
FIG. 1 is a cross section view of a prior art small-particle coupler particle formed by precipitation.
Figure 2:
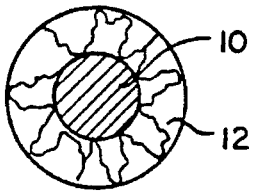
(PRIOR ART) FIG. 2
FIG. 2 is a cross section view of a small-particle coupler dispersion formed by precipitation, surrounded by a layer of adsorbed gelatin molecules.
Figure 3:
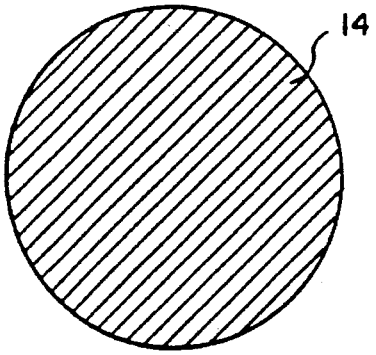
(PRIOR ART) FIG. 3
FIG. 3 is a cross section view of the large coupler particle, of the prior art, formed by a milling procedure.
Figure 4:
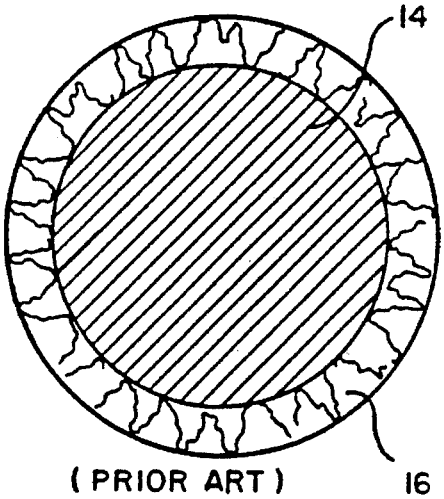
(PRIOR ART) FIG. 4
FIG. 4 is a cross section view of the large coupler particle, of the prior art, surrounded by a layer of adsorbed gelatin molecules.

Dispersion melts of small particles of diameter less than about 100 nm in gelatin have been difficult to formulate with low viscosities with low amounts of surfactants. It is theorized that the reason for this is that particles of coupler in gelatin solution adhere or adsorb gelatin to their surface. The thickness of the adhered layer is considered to be substantially the same regardless of particle size. Therefore, if there are many fine particles making up the same weight of coupler in a dispersion as compared with the similar dispersion of larger particles of the same total weight of the dispersed material, there will be a much greater amount of surface area in the dispersion of small particles. Therefore as there is greater amount of surface area, there will be a greater amount of gelatin that is adhered to the particle surface and removed from the dispersion thereby raising the viscosity of the dispersion by drastically increasing the hydrodynamic volume of the particles. The drawings of FIGS. 1, 2, 3, and 4 illustrate this phenomenon. In FIG. 2 is illustrated coupler particles 10 having adhered thereto a unimolecular layer of gelatin 12. As represented the particle 10 is a fine or small particle. As illustrated the layer of gelatin is of a thickness of about the diameter of the particle. FIG. 3 illustrates a larger milled coupler particle 14 of the prior art. As illustrated in FIG. 4 this particle is shown in a gelatin dispersion having a gelatin layer 16 adhered thereto. The larger particle 14 has an illustrated diameter much greater than that of particle 10 but the adhered gel layer 16 is about the same thickness. Simple calculations as given below show that the increase in the hydrodyanmic volume fraction of a small particle dispersion having an adhered gelatin layer is about 135% as compared with about 9% for that of a larger particle dispersion having an adhered gelatin layer, both dispersions being at the same coupler content of 5%.

Hydrodynamic volume ratio of small particle (SP) (diameter=20 nm, radius=10 nm) coupler dispersion after adsorption of a gel layer (thickness of gelatin layer=20 nm) is $$R_{SP}=\frac{\frac{4}{3}\Pi(10+20)^3}{\frac{4}{3}\Pi(10)^3}=\left[\frac{30}{10}\right]^3=27$$

Therefore, the hydrodynamic volume fraction of the particle phase of the dispersion of a small particle coupler dispersion containing 5% coupler is about 5×27=135%. It is not actually possible for the hydrodynamic volume fraction of the dispersed phase to exceed 100% of the volume of the dispersion; however, this simple computation indicates that the adsorption of gelatin onto the small particle dispersion causes the hydrodynamic volume fraction of the dispersion to increase dramatically.

In contrast hydrodynamic volume ratio of large particle (LP, diameter=200 nm, radius=100 nm) coupler dispersion after adsorption of a gel layer (thickness of gelatin layer as before=20 nm) is $$R_{LP}=\frac{\frac{4}{3}\Pi(100+20)^3}{\frac{4}{3}\Pi(100)^3}=\left[\frac{120}{100}\right]^3=1.7$$

The hydrodynamic volume fraction of the particle phase of the dispersion of a large particle coupler dispersion containing 5% coupler is about 5×1.7=8.5%. Such simple calculations, therefore, show that the adsorption of gelatin onto large particle dispersion particles causes the hydrodynamic volume fraction of the dispersion to increase only slightly.

It can be seen by this simple calculation that in a dispersion of 5% coupler with gelatin, the gelatin will be substantially removed from the solution by adhering to the fine particles. This will lead to a large increase in the volume fraction of the dispersed phase producing a large viscosity of the gelled small particle dispersion. However, in the case of large particle dispersion, the effective increase of the volume fraction of the dispersed phase is small, which results in dispersions with relatively low viscosities.

A second probable reason for high viscosity of such prior art small particle microprecipitated dispersion is due to the bonding of the same gelatin molecule to more than one particle. This phenomenon is called bridging. In small particle dispersions, compared to a conventional milled large particle dispersion of the same concentration, there are much larger numbers of particles per unit volume. Therefore, the average distance between the surfaces of small particle dispersions is much smaller than that in a large particle dispersion at the same solids of the dispersed phase. Therefore, when gelatin is added to a concentrated small particle dispersion to prepare a melt, the same gelatin molecule can attach to multiple numbers of particles causing formation in bridged clusters and thereby raising the viscosity of the melt to very large values, resulting in an uncoatable melt.

Figure 1A:
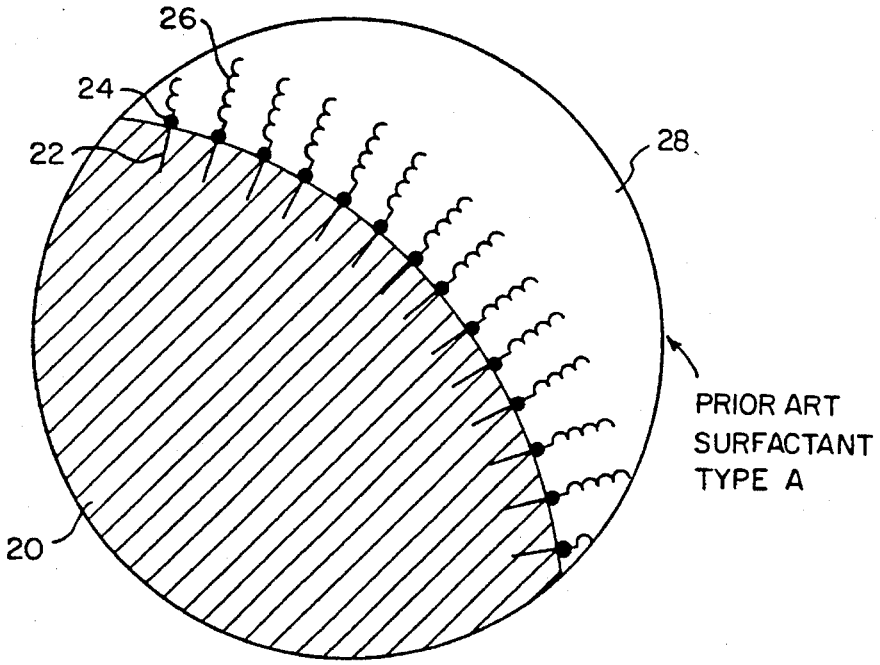
FIGS. 1A and 1B show an enlarged view of the interface of the small coupler-particle of FIG. 1, illustrating the adsorption of prior art surfactant to the particle interface.
Figure 1B:
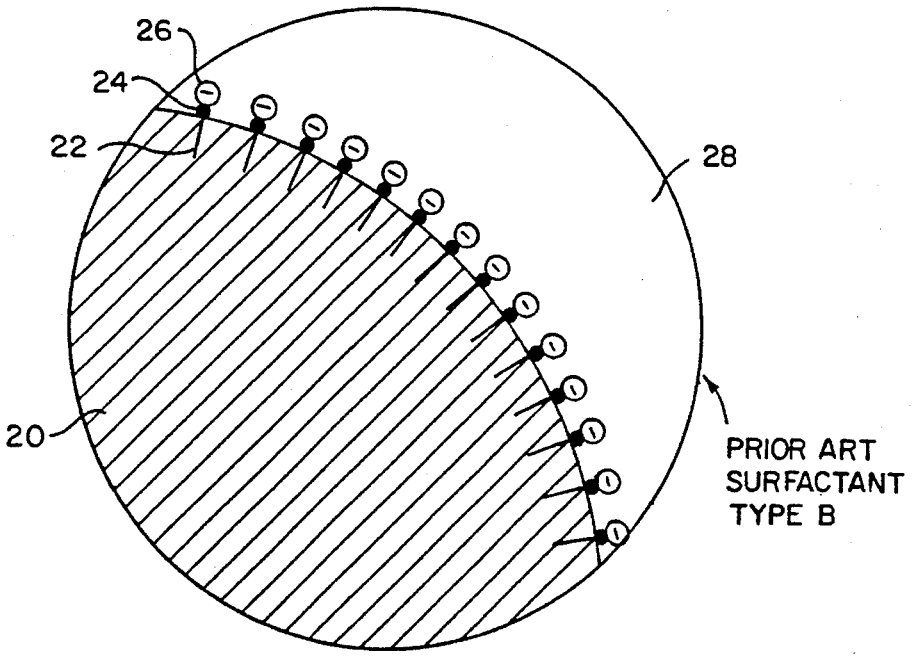
( PRIOR ART ) FIG. 1b
Figure 5:
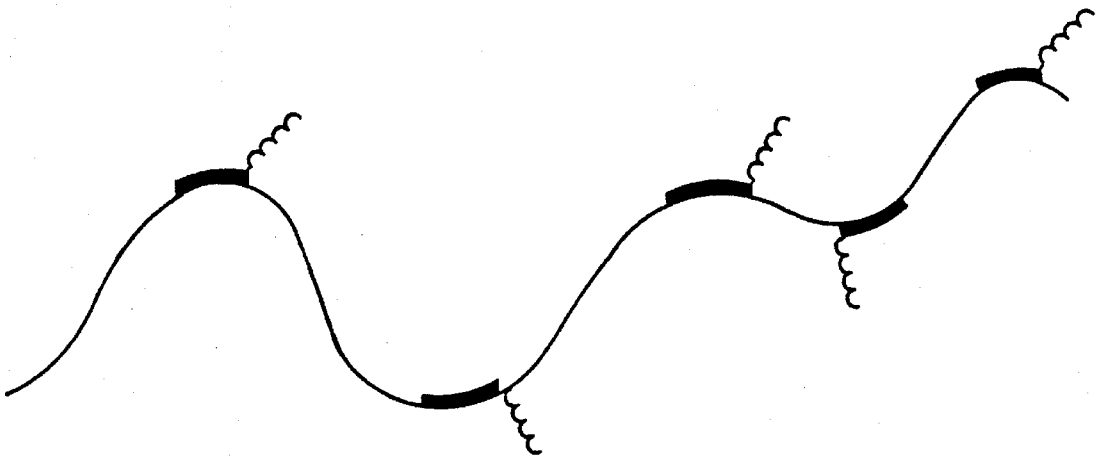
FIG. 5 is a pictorial view of the attachment of the sugar surfactant, of this invention, to the hydrophobic sites of a gelatin molecule.

When the sugar surfactant A or B is added to a gelatin solution, they attach themselves through their hydrophobic tails to the hydrophobic segments of the gelatin molecule (FIG. 5), converting the gelatin molecule to a very hydrophilic entity. Since gelatin also attaches or binds to particle surface through their hydrophobic segments, blocking these sites on the gelatin molecule by the attachment of the surfactants of this invention prevents the attachment of the gelatin molecule to the surface of the coupler dispersions as indicated in FIGS. 1*a* and 1*b*. Thus, it prevents bridging of the small particle in the dispersion or prevents the formation of the adsorbed gelatin layer round the microprecipitated particles as shown in FIG. 2, leading to a low viscosity gelatin melt.

In the examples are shown the precipitated small particle dispersions of the previously indicated prior art of Priest using the yellow coupler of the following structure:

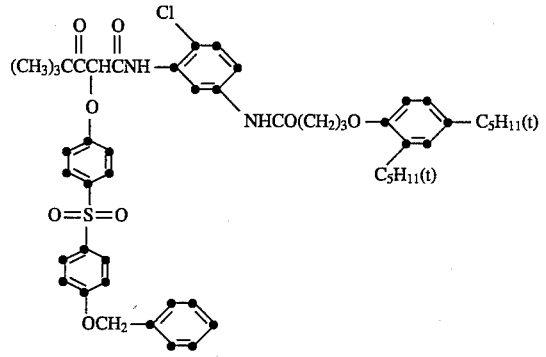

Yellow Image Coupler (C-1)

The invention is suitable for precipitated small particle dispersions of many couplers and photographic compounds. Yellow and magenta couplers generally suitable for the invention are the Yellow Couplers

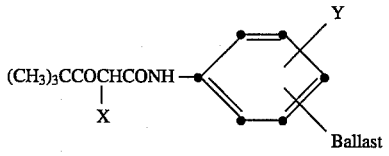

PIVALYLACETANILIDE dye forming coupler

X—is a suitable leaving group or H.

Y—is an organic moiety.

and the

Magenta Couplers

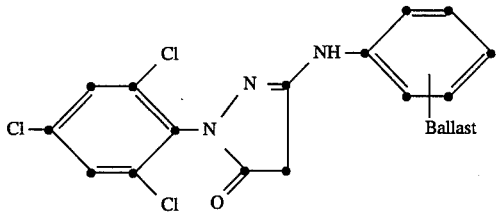

TRICHLOROPHENYL PYRAZOLONE Couplers such as (C-2)
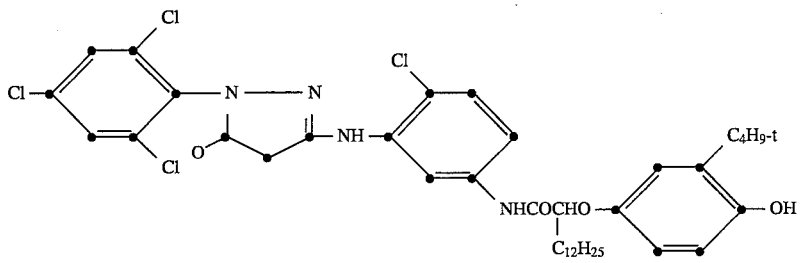
Stabilizers for the magenta couplers suitable for use with the invention are a phenolic radical scavengers and hydroquinone radical scavengers.
Small-particle dispersions of other dye-forming couplers and photographically useful compounds suitable for this invention are:
(C-3)
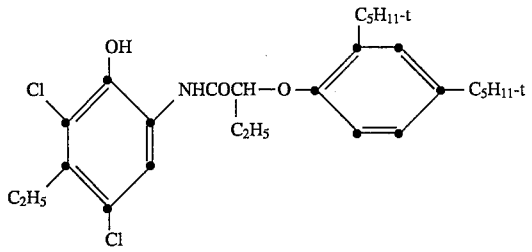
(C-4)
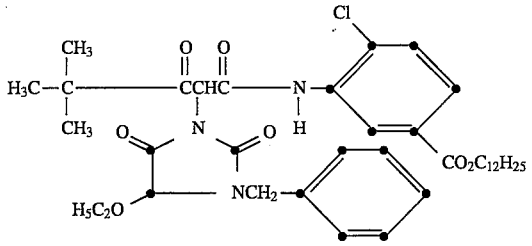
(C-5)
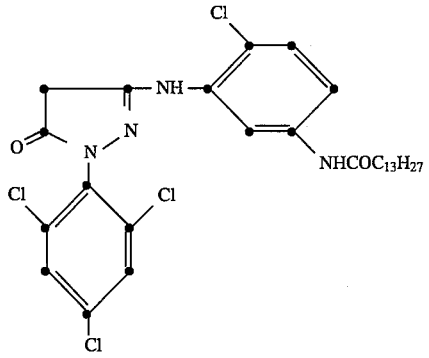
(C-6)
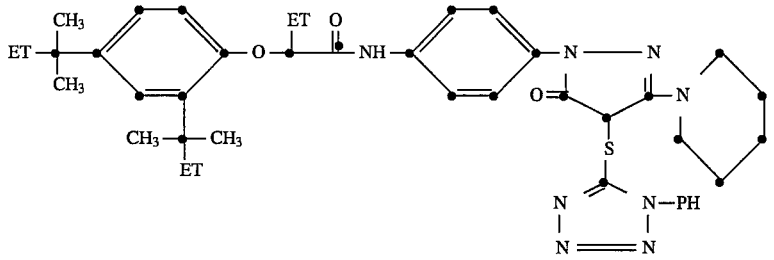

-continued
(C-7)
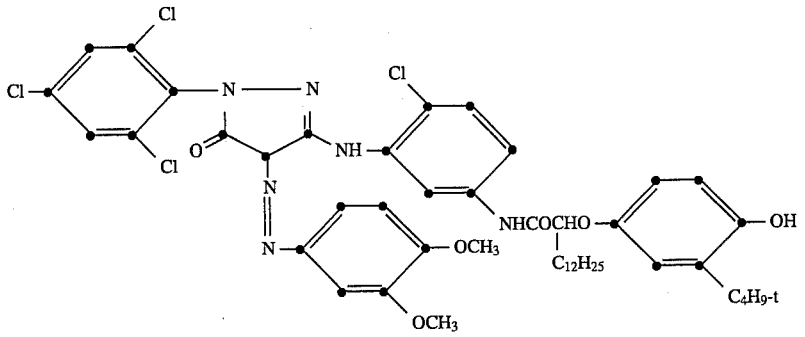
(C-7A)
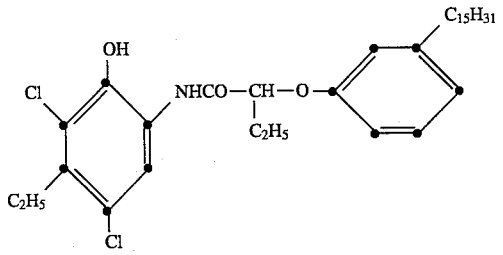
(C-8)
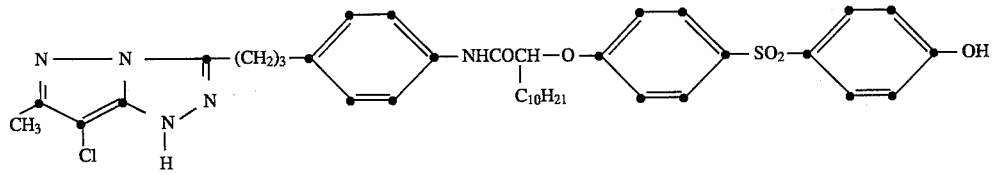
(C-9)
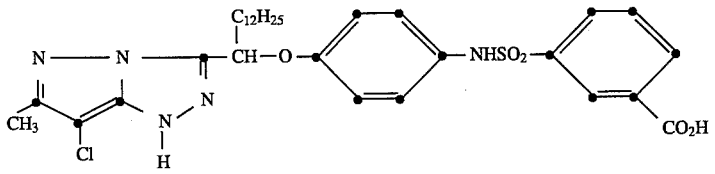
(C-10)
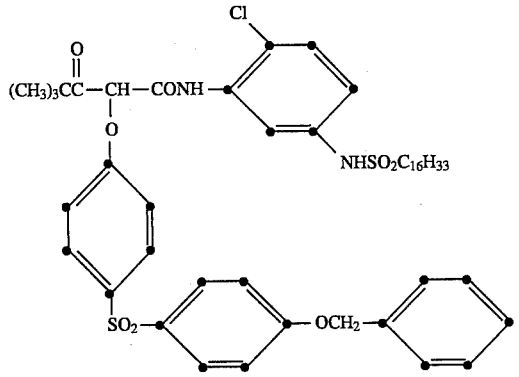

-continued (C-11)

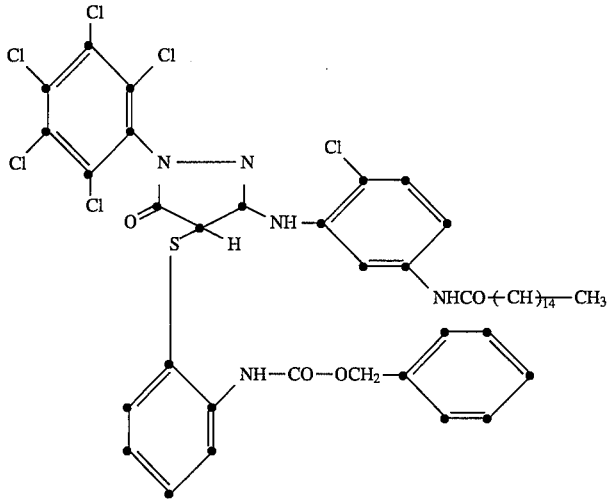

(C-12)

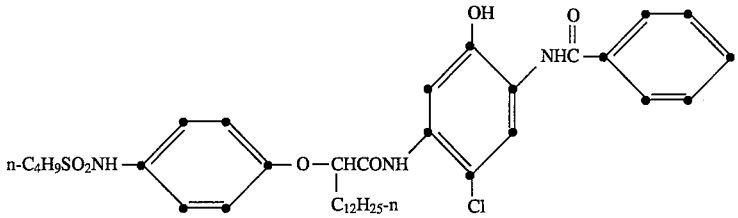

(C-13)

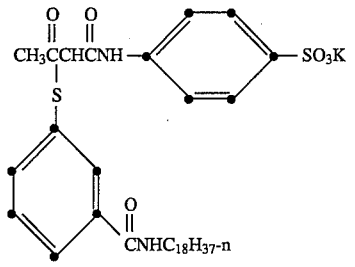

(C-14)

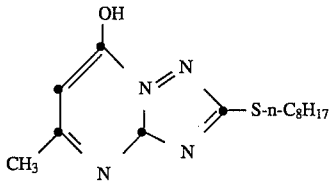

(C-15)

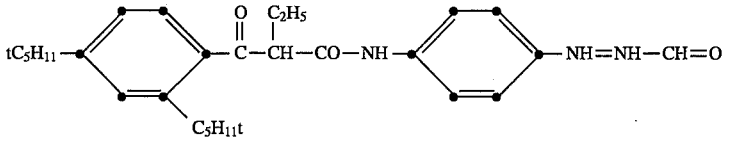

(C-16)

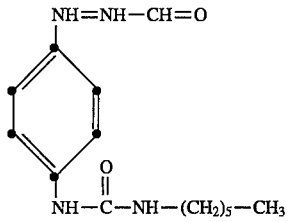

There are many surfactants that have been used or can be used in preparation of prior art conventional milled dispersions or microprecipitated small particle dispersions by themselves or a mixture thereof. A representative list of such surfactants is shown in Table I. These surfactants can, for the purpose of elucidation of this invention, be divided into two general classes, as follows:

Type A: Surfactant whose hydrophobic segment is composed of an aliphatic or aromatic hydrocarbon moiety composed of between 6 to 22 carbon atoms and a hydrophilic segment comprising one or more sulfate or sulfonate groups.

Type B: Surfactant whose hydrophobic segment is composed of an aliphatic or aromatic hydrocarbon moiety composed of between 6 to 22 carbon atoms and a hydrophilic segment comprising between 2 to 20 oxyethylene or glycedylether groups with or without termination by a sulfate or a sulfonate group.

The surfactant list in Table I also indicates the type of the surfactant based upon the above classification.

TABLE I

Structures of Prior Art Surfactants Used in the Preparation of Conventional and Microprecipitated Dispersions

| Surfactant ID | Name (Manufacturer) | Best Known Structure | Formula (MW) | Class |
|---|---|---|---|---|
| S-1 | Sodium Dodecyl-sulfate (SDS) (E.K. Co.) | $CH_3-(CH_2)_{11}-OSO_3Na^+$ | $C_{12}H_{25}O_4SNa$ (288) | A |
| S-2 | Aerosol OT (Cyanamid) | 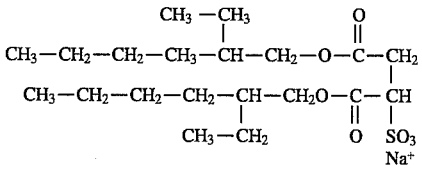 | $C_{20}H_{37}O_7SNa$ (444) | B |
| S-3 | Aerosol 22 (Cyanamid) | 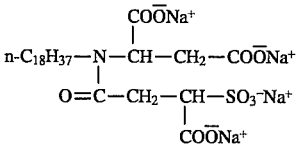 | $C_{26}H_{43}O_{10}SNa$ (639) | B |
| S-4 | Aerosol A103 (Cyanamid) | 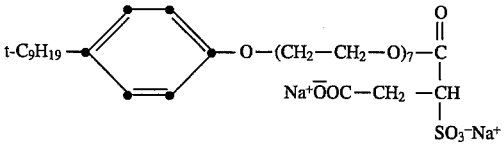 | $C_{33}H_{54}O_{14}SNa_2$ (753) | B |
| S-5 | Octyl Hydroxy-ethyl sulfoxide (KRL) | 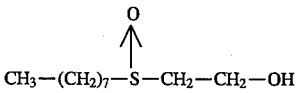 | $C_{10}H_{22}S_2$ (206) | — |
| S-6 | Hamposyl L-30 (Grace) | 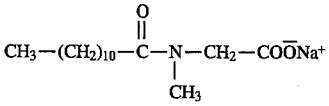 | $C_{15}H_{28}O_3NNa$ (293) | — |
| S-7 | Arlacel-20 (ICI) | 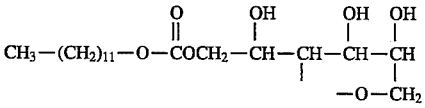 | $C_{19}H_{36}O_6$ (360) | — |
| S-8 | Olin 10G (Dixie) | 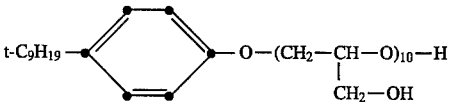 | $C_{45}H_{84}O_{21}$ (961) | B |
| S-9 | Polystep B-12 (Stepan) | $n\text{-}C_{12}H_{25}-O-(CH_2-CH_2-O)_4-SO_3^-Na^+$ | $C_{20}H_{41}O_8NaS$ (464) | B |
| S-10 | Polystep B-23 (Stepan) | $n\text{-}C_{12}H_{25}-O-(CH_2-CH_2-O)_{12}-SO_3^-Na^+$ | $C_{36}H_{73}O_{16}SNa$ (817) | B |
| S-11 | Mazol PG-L101 (Maxer) | $n\text{-}C_{11}H_{25}-\underset{\underset{O}{\|}}{C}-O-(CH_2-\underset{\underset{CH_2OH}{\|}}{CH}-O)_{10}-H$ | $C_{42}H_{84}O_{22}$ (941) | B |
| S-12 | Mazol PG-P101 (Mazer) | $n\text{-}CH_3-(CH_2)_{14}-\underset{\underset{O}{\|}}{C}-O-(CH_2-\underset{\underset{CH_2OH}{\|}}{CH}-O)_{10}-H$ | $C_{45}H_{92}O_{22}$ (997) | |
| S-13 | Mazol PG-P61 (Mazer) | $n\text{-}CH_3-(CH_2)_{14}-\underset{\underset{O}{\|}}{C}-O-(CH_2-\underset{\underset{CH_2OH}{\|}}{CH}-O)_6-H$ | $C_{34}H_{68}O_{14}$ (701) | B |

TABLE I-continued

Structures of Prior Art Surfactants Used in the Preparation of Conventional and Microprecipitated Dispersions

| Surfactant ID | Name (Manufacturer) | Best Known Structure | Formula (MW) | Class |
|---|---|---|---|---|
| S-14 | Triton TX-200E (Rohm & Haas) (E.K. Co.) | $C_3H_{17}$— 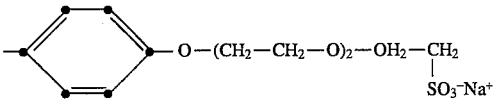 85% and $C_3H_{17}$— 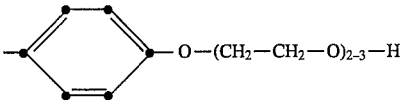 15% | — (~400) | B |
| S-15 | Triton TX-114 (Rohm & Haas) | $C_3H_{17}$— 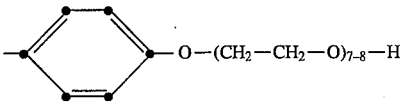 | — (~540) | B |
| S-16 | Triton TX-102 (Rohm & Haas) | $C_8H_{17}$— 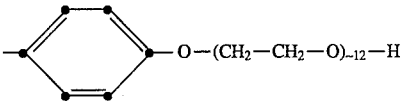 | ~$C_{36}H_{70}O_{13}$ (~734) | B |
| S-17 | Tricol LAL-8 (Emery) | n-$C_{12}H_{25}$—O—($CH_2$—$CH_2$—O)$_{\sim 8}$—H | ~$C_{28}H_{58}O_9$ (~539) | B |
| S-18 | Tricol LAL-12 (Emery) | n-$C_{12}H_{25}$—O—($CH_2$—CH—O)$_{\sim 12}$—H | ~$C_{36}H_{26}O_{13}$ (~714) | B |
| S-19 | Tricol LAL-23 (Emery) | n-$C_{12}H_{25}$—O—($CH_2$—CH—O)$_{\sim 23}$—H | ~$C_{58}H_{95}O_{24}$ (~1198) | B |
| S-20 | Avanel S-30 (PPG) | n-$C_{12}H_{25}$—O—($CH_2$—$CH_2$—O)$_4$—$CH_2$—CH(—$SO_3^-Na^+$) | ~$C_{20}H_{41}O_7SNa$ (~448) | B |
| S-21 | Avanel S-70 (PPG) | n-$C_{12}H_{25}$—O—($CH_2$—$CH_2$—O)$_7$—$CH_2$—CH(—$SO_3^-Na^+$) | ~$C_{28}H_{57}O_{11}SNa$ (~624) | B |
| S-22 | Avanel S-150 (PPG) | $C_{12}H_{25}$—O—($CH_2$—$CH_2$—O)$_{15}$—$CH_2$—CH(—$SO_3^-Na^+$) | ~$C_{44}H_{89}O_{19}SNa$ (~976) | B |
| S-23 | Alkanol XC (DuPont) | 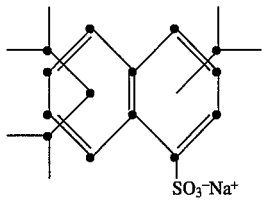 (control) | ~$C_{15}H_{25}SO_3Na$ (~260) | A |
| S-24 | Aerosol A102 (Cyanamid) | n-$C_{12}H_{25}$—O—($CH_2$—$CH_2$—O)$_n$—C(=O)—CH($CH_2$—$COO^-Na^+$)—$SO_3^-Na^+$ n = 3 to 5 | ~$C_{24}H_{44}O_{11}S_2Na_2$ (~618) | B |

All above prior art surfactants (both class A and B) and combination of such surfactants may be used to prepare microprecipitated dispersions as disclosed in copending U.S. application Ser. No. 297,005 now U.S. Pat. No. 4,990,431. Generally the invention finds its preferred embodiments in the particle sizes typically formed by the phase separation precipitation process. These particles are typically below about 100 nm. The typical size ranges are between about 10 and 50 nm with the preferred range being between about 10 and about 30 nm, as effective viscosity control surface active agents are most important with smaller particles. The term fine or small particle dispersion as utilized herein is intended to refer to those particles below about 100 nm. As in many microprecipitated dispersions, small particle size translates to higher activity, small particles are more desirable, as they lead to both coupler and silver laydown resulting in considerable cost savings. In the Examples it will be shown that the smaller the particle size, the larger is the resulting dye density yield for the same laydown of coupler and silver. The microprecipitated dispersions of the copending U.S. application Ser. No. 297,005 now U.S. Pat. No. 4,990,431 are prepared with 20% to 30% (usually 25%) of surfactant based upon the coupler utilized. The surfactants are those of the surfactants of class A or B or a mixture of both A and B types.

These materials are typically formulated for use in photographic systems in admixture with gelatin at a composition of 8% coupler and 5% gelatin to produce dispersion with viscosities much larger than 100 centipoise at 50° C. and 66 $sec^{-1}$ of shear rate. At such high viscosities melts can not be coated without defects using conventional multilayer slide hopper coating devices that are generally utilized for coating photographic films. Prior art surfactants of Class-B can be added to reduce the melt viscosity. However, the amount of Class-B surfactants needed to reduce the viscosity of such melts are so high that it leads to other defects in coated multilayer products such as EKTACOLOR paper. It will be shown that the addition of the prior art surfactant (S-24) at a level of 0.6 g of surfactant per g of coupler to the 8% coupler, 5% gelatin small-particle dispersion lowers the viscosity to less than 25 cp, which is necessary for satisfactory slide hopper coatings of the melts. All viscosity values in the Examples are measured at 50° C. and 66 $sec^{-1}$ using either a Brookfield LVDT viscometer or a Contraves Rheomat-108. It will also be shown that the use of surfactants of this invention require much less than half the amount of surfactant required with prior art surfactant (S-24) to bring the viscosity down to about the same level. This not only constitutes cost savings, but also minimization of adverse photographic effects already pointed out that arise from the use of an excessive quantity of surfactant. It will also be shown in the Examples that use of excessive quantity of surfactants of Class-B as is needed for surfactant (S-24) leads to yellowing in the magenta layer of EKTACOLOR paper due to an unusual interaction of the prior art surfactants of Class-B with the EKTACOLOR paper magenta layer coupler (C-2). EKTACOLOR is a trademark of the Eastman Kodak Co. Even if such surfactants are used in excessive amounts in other layers such as the yellow layer, the surfactant molecules migrate to the magenta layer during processing and keeping and produce a yellow stain. Therefore, for use in EKTACOLOR paper that contains coupler (C-2) in the magenta layer, viscosity control must be accomplished with surfactants other than the prior art surfactants of type B.

It is to be noted that excessive addition of prior art surfactants of type A in general increases the melt viscosity. Composition of the melt being specified earlier. However, some of the type A surfactants are very effective in the preparation of microprecipitated dispersions with small particle size.

Large particle dispersions made by conventional milling procedures of prior art (Eg., The Theory of the Photographic Processes, Ed. Th. James, 4th Ed., Macmillan, New York, 1977, page 348) are generally prepared using the surfactant Alkanol XC (S-23).

Figure 6:
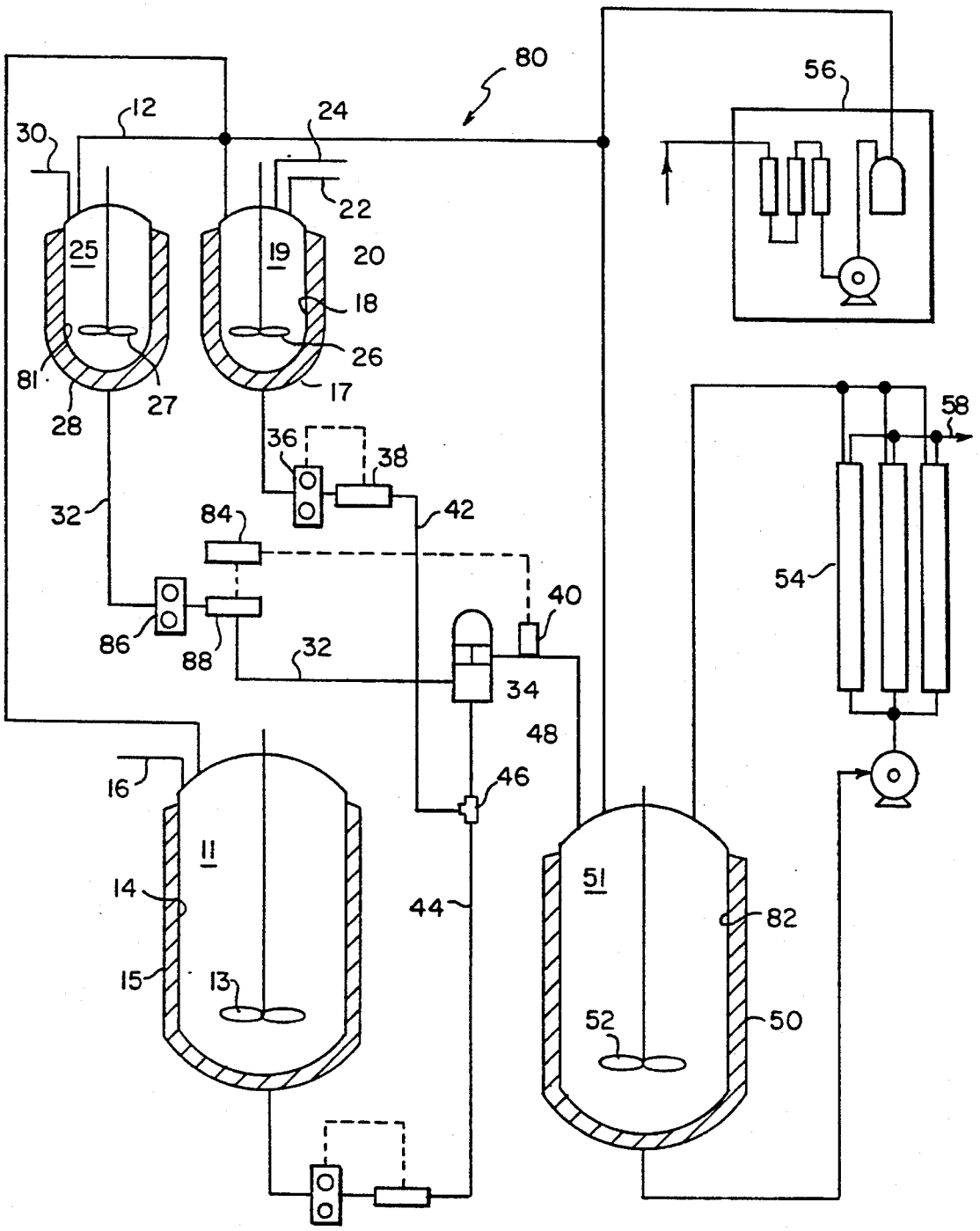
FIG. 6 illustrates the equipment utilized for the precipitation of the small particle prior art dispersions utilized in this invention, in large scale and concentrated form.

A Brief Description of the Apparatus for the Preparation of the Small Particle Dispersions Utilized in This Invention The schematic of FIG. 6 illustrates apparatus 80 for the preparation of the small particle dispersions utilized to demonstrate this invention. The apparatus is provided with high purity water delivery lines 12. Tank 14 contains a solution 11 of surfactant and high purity water. Jacket 15 on tank 14 regulates the temperature of the tank. Surfactant enters the tank through line 16. Tank 18 contains a photographic component solution 19. Jacket 17 controls the temperature of materials in tank 18. The tank 18 contains a coupler entering through manhole 20, a base material such as aqueous sodium hydroxide solution entering through line 22, and solvent such as n-propanol entering through line 24. The solution is maintained under agitation by the mixer 26. Tank 81 contains acid solution 25 such as propionic acid entering through line 30. The tank 81 is provided with a heat jacket 28 to control the temperature, although with the acids normally used, it is not necessary. In operation, the acid is fed from tank 81 through line 32 to mixer 34 via the metering pump 86 and flow meter 88. A pH sensor 40 senses the acidity of the dispersion as it leaves mixer 34 and allows the operator to adjust the acid pump 86 to maintain the proper pH in the dispersion exiting the mixer 34. The photographic component 19 passes through line 42, metering pump 36, flow meter 38, and joins the surfactant solution in line 44 at the T fitting 46. The particles are formed in mixer 34 and exit through pipe 48 into the ultrafiltration tank 82. In tank 82 the dispersion 51 is held while it is washed by ultrafiltration membrane 54 to remove the solvent and salt from solution and adjust the material to the proper water content for makeup as a photographic component. The source of high purity water is purifier 56. Agitator 13 agitates the surfactant solution in tank 14. Agitator 27 agitates the acid solution in tank 81. The impurities are removed during the ultrafiltration process through permeate (filtrate) stream 58.

In order to prepare a melt containing 8% coupler and 5% gelatin, it is necessary to use microprecipitated dispersions at 12% coupler or higher. The apparatus described above is capable of preparing dispersions of such concentrations in large volumes. However, for general testing of activity of such microprecipitated dispersions, in single layers, a dispersion of 2.5% coupler is sufficient. Under such high dilutions, high viscosity problems are not encountered. However, such melts are suitable for testing and not for production coatings, especially for dispersion systems used in high volume products such as EKTACOLOR paper or EASTMAN COLOR PRINT. For comparison and testing of activities, microprecipitated dispersions were prepared using the small scale device illustrated in FIG. 7.

Figure 7:
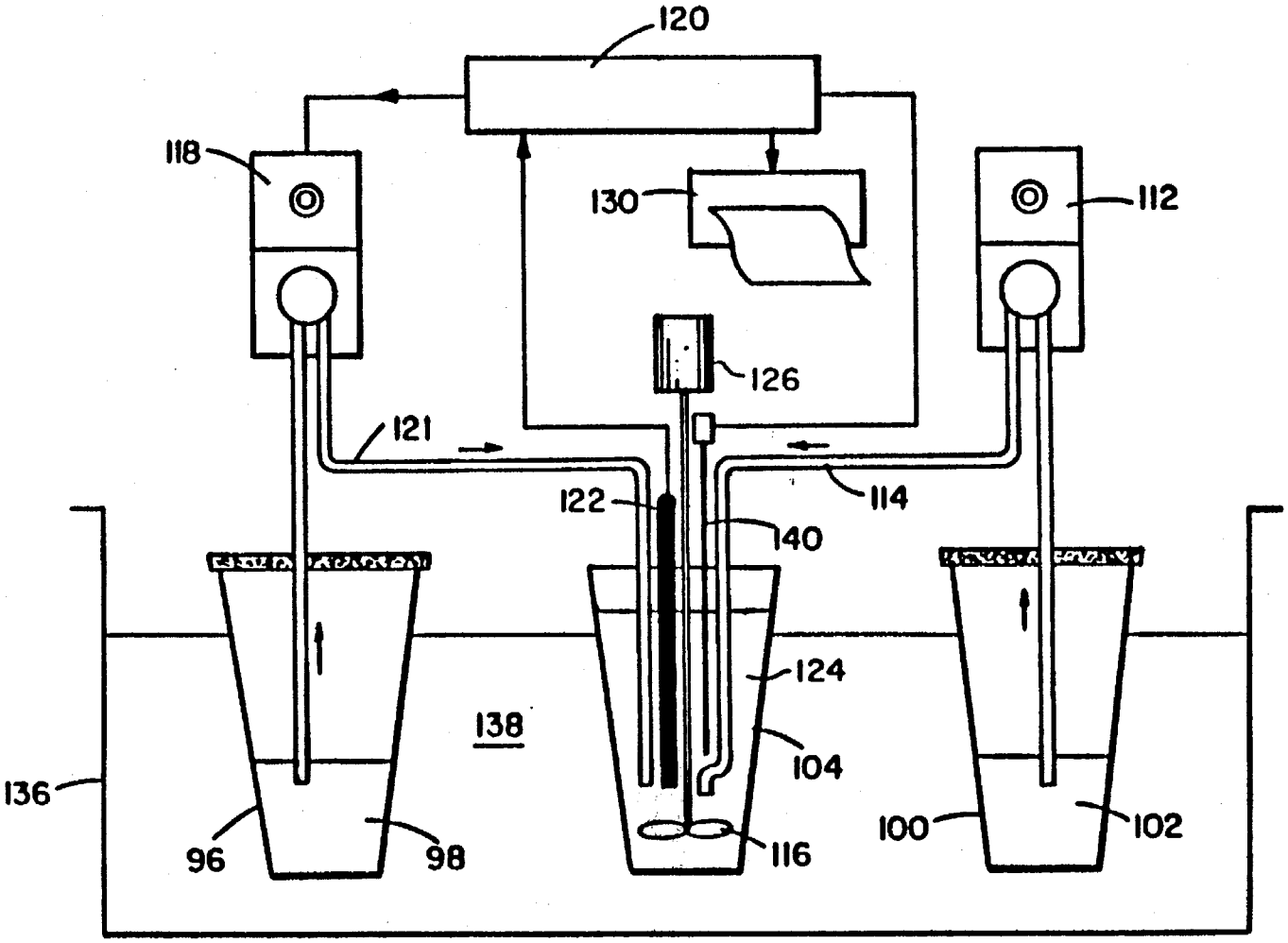
FIG. 7 illustrates the equipment utilized for the precipitation of the small particle prior art dispersions utilized in this invention, in small scale and dilute form for testing of activity of the dispersions.

FIG. 7 illustrates the semicontinuous equipment to prepare microprecipitated dispersions as those utilized in this invention for small laboratory size preparation for testing of coupler activity. This equipment is used for the preparation of the invention dispersion in volumes up to 700 mL, in semicontinuous mode for a total coupler weight of 20 g. Container 104 is provided with an aqueous surfactant solution in alkali 124. Container 96 is provided with an acid solution 98. Container 100 combines a basic solution 102 of coupler in solvent. Container 104 provides high shear mixing and is the reaction chamber where dispersion formation takes place. The size of the acid kettle 96, the coupler kettle 100, and the reaction kettle are all of about 800 mL in capacity. In the system of FIG. 7, the reactor 104 is initially provided with an aqueous solution of the surfactant. The coupler is dissolved in base and a water-miscible solvent generally at an elevated temperature in a separate vessel and then cooled down to room temperature and placed in kettle 100. The dispersion preparation process is started by starting the coupler pump 112, which pumps basic coupler solution into the reaction chamber 104 under continuous agitation provided by the stirrer 116. The pH is monitored during all stages of the precipitation process using pH meter 120 which is connected to the pH-electrode system 122 and a thermostat probe 140 for temperature sensing. The pH is recorded on the strip chart recorder 130. After the coupler solution has been pumped into the reaction chamber 104, pump 112 is stopped and pump 118 is started to pump acid solution into the reaction chamber 104 via tube 121 for the neutralization and precipitation of the coupler, under vigorous stirring. The acid solution is pumped until the pH of the reaction chamber reaches a pH of 6.0± 0.2, at which time this acid pump 118 is shut off. The constant temperature bath 136 is provided to keep the temperature of the three kettles identical. It is usually kept at about room temperature.

Dispersions prepared in this manner are washed by continuous dialysis against distilled water for 24 hours to remove all the salts and solvent from the formed dispersion.

The couplers and photographic agent that can be utilized for preparations of such microprecipitated dispersions are (C-1) through (C-16) using surfactants of class A and B or a mixture thereof as listed in Table I.

The solvent for dissolving the photographic component may be any suitable solvent that may be utilized in the system in which precipitation takes place by solvent shift and/or acid shift. Typical of such materials are the solvents acetone, methyl alcohol, ethyl alcohol, isopropyl alcohol, tetrahydrofuran, dimethylformamide, dioxane, N-methyl-2-pyrrolidone, acetonitrile, ethylene glycol, ethylene glycol monobutyl ether, diacetone alcohol, etc. A preferred solvent is n-propanol because n-propanol allows the particles to stay dissolved longer after formation and cooling the coupler solution.

It is also possible to add a permanent high boiling solvent to the dispersion of photographic component dissolved in the volatile solvent. The permanent solvent would be added after concentration of the photographic component by diafiltration of the volatile solvent dispersion. The addition of permanent solvent may be desirable to increase dye fade of a particular photographic component to maintain neutral fade in a multicolor final product. The permanent solvent may be one of those disclosed in U.S. Pat. No. 4,970,139.

The acid and base may be any materials that will cause a pH shift and not significantly decompose the photographic components. The acid and base utilized in the invention are typically sodium hydroxide as the base and propionic acid or acetic acid as the acid, as these materials do not significantly degrade the photographic components and are low in cost.

This prior art microprecipitation process leads to gelatin free, fine particle colloidal dispersions of photographic materials.

Several of the embodiments of the invention are:

- a composition wherein the small particle microprecipitated photographic material comprises coupler material that has a diameter less than 100 nm;
- a composition wherein the small microprecipitated dispersion particles have a diameter of less than 20 nm;
- a multilayer photographic element wherein the small particle microprecipitated material has a particle diameter of less than 100 nm;
- a multilayer photographic element wherein the small particle microprecipitated material has a particle diameter of less than 20 nm;
- a process wherein particles of photographic material dispersion have a diameter of less than 100 nm;
- a process wherein the photographic material particles have a particle diameter less than 20 nm;
- a process wherein a stable photographic material dispersion comprises particles of a diameter less than 100 nm;
- a process wherein the photographic material particles have a particle diameter less than 20 nm.

Mode of Viscosity Characterization and Measurement of the Invention

The viscosity of the dispersion formed in accordance with the invention may be adjusted to any desired amount by the addition of varying amounts of the surfactants of the invention. However, typically it is preferred that the surfactant be utilized in amounts of below about 25% of the amount of coupler by weight. This is preferred as it minimizes the possibility of yellowing or other defects associated with high surfactant use.

The viscosity for utilization of emulsions in present commercial coating machines should be below about 25 cP (at 50° C. and 65 $sec^{-1}$) for defect free multilayer slide hopper coatings. The term low viscosity as utilized in the description of this invention is intended to mean viscosity of below about 25 cP (at 50° C. and 66 $sec^{-1}$). It is understood that the surfactant of the invention may also be used in very small amounts to obtain higher viscosity dispersion melts that may be appropriate, such as in the case where coated layers are made, forming stable, simultaneously free falling, vertical curtain of a multilayer composite impinging on a moving surface onto which the coating is to be made (curtain coating; prior art U.S. Pat. No. 3,508,947). However, the invention particularly is directed to the use of low viscosity dispersion melts, such as necessary for commercial slide hopper coating U.S. Pat. No. 2,761,791).

The couplers utilized in forming the fine particle dispersion melts of this invention may be any couplers that are used in photographic or other small particle dispersion applications. Typical of such couplers are image couplers. Preferred coupler for use in this invention is that indicated earlier as compound (C-1).

All viscosity values reported in this invention are in the units of centipoise (CP). These were measured at 50° C. and 66 reciprocal seconds of shear using either a Brookfield LVDT viscometer for viscosities lower than 100 CP or a Contrayes Rheomat-108 for viscosities larger than 100 CP.

All particle size measurements of the microprecipitated dispersion were carried out by photocorrelation spectroscopy (PCS) and those of conventional milled dispersions by sedimentation field flow fractionation (SFFF).

EKTACOLOR Paper System

This invention pertains to current EKTACOLOR paper (*Research Disclosure*, Vol. 303, p. 933, 1989) in the full color multilayer structure. The multilayer structure of a model EKTACOLOR paper system is given in Table II. Such coatings are made in a simultaneous multilayer coating machine.

The solvents used in preparation of conventional prior art milled dispersions are as follows:

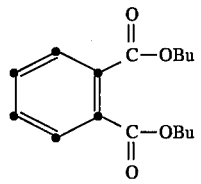

(SV-1)

$$CH_3-\overset{\overset{\displaystyle O}{\|}}{C}-O-CH_2-CH_2-O-CH_2-CH_2-O-Bu$$

(SV-2)

The proportions of these used in preparation of the dispersions will be given in the examples concerning the prior art milled control dispersions.

The incorporated oxidized developer scavenger used has the following structure:

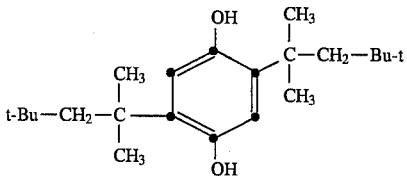

(SC-1)

The stabilization for the magenta coupler has the following structure:

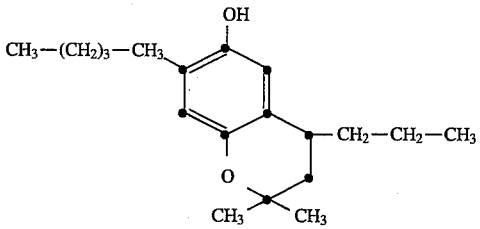

(ST-1)

The ultraviolet variation absorbing compounds utilized are the two following Ciba-Giegy compounds:

Tinuvin 326

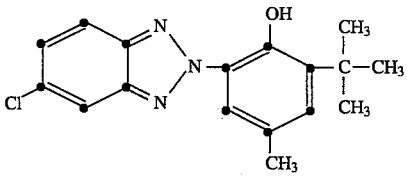

(UV-1)

Tinuvin 328

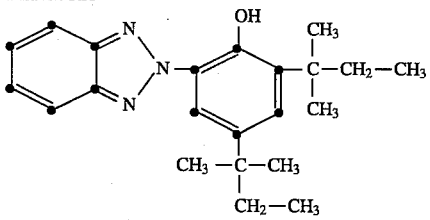

(UV-2)

The specific dispersions prepared with these compounds will be described in detail in the appropriate examples.

The white light exposures of the coated films were made using a sensitimeter with properly filtered white light (*Research Disclosure*, Vol. 308, p. 933, 1989), with a neutral step wedge of 0.15 neutral density steps. Color separation exposures were made similarly with properly filtered light. All processing was carried out using the well-known RA4 development process (*Research Disclosure*, Vol. 308, p. 933, 1989).

TABLE II

| Layer Structure of a Model Multilayer Ektacolor Paper System (Numbers indicate coverage in mg per square ft.) |
|---|
| LAYER-7 |
| Overcoat: |
| 125.0 Gelatin |
| 2.0 (SC-1) (Conventional Scavenger Dispersed in Solvent) |
| LAYER-6 |
| UV Protection Layer: |
| 61.0 Gelatin |
| 34.3 Tinuvin 328 (Co-dispersed in Solvent) |

TABLE II-continued

| Layer Structure of a Model Multilayer Ektacolor Paper System (Numbers indicate coverage in mg per square ft.) |
|---|
| 5.7 Tinuvin 326 (Co-dispersed in Solvent) |
| 4.0 (SC-1) (Co-dispersed in Solvent) |
| LAYER-5 |
| Red Layer: |
| 115.0 Gelatin |
| 39.3 (C-3) (Cyan Coupler Co-dispersed in Solvent) |
| 0.5 (SC-1) (Scavenger Co-dispersed in Solvent) |
| 16.7 AgCl (In Red Sensitized AgCl Emulsion) |
| LAYER-4 |
| UV Protection Layer: |
| 61.0 Gelatin |
| 34.3 Tinuvin 328 (Co-dispersed in Solvent) |
| 5.7 Tinuvin 326 (Co-dispersed in Solvent) |
| 4.0 (SC-1) (Co-dispersed in Solvent) |
| LAYER-3 |
| Green Layer: |
| 115.0 Gelatin |
| 41.5 (C-2) (Magenta Coupler Co-dispersed in Solvent) |
| 18.2 (ST-1) (Stabilizer Co-dispersed in Solvent) |
| 3.4 (SC-1) (Scavenger Co-dispersed in Solvent) |
| 26.5 AgCl (In Green Sensitized AgCl Emulsion) |
| LAYER-2 |
| Inter Layer: |
| 70.0 Gelatin |
| 9.0 (SC-1) (Scavenger Dispersed in Solvent) |
| LAYER-1 |
| Blue Layer: |
| 140.0 Gelatin |
| 100.0 (C-1) (Yellow Coupler Dispersed in Solvent) |
| 30.0 AgCl (In Blue Sensitized AgCl Emulsion) |
| Resin Coat: Titanox Dispersed in Polyethylene |
| Support: Paper |
| Resin Coat: Polyethylene |

Automated Dispersion Reactivity Analysis

A kinetic analysis is carried out by treating the coupling reaction as a homogeneous single phase reaction. It is also assumed that the coupling reaction and the sulfonation reaction (sulfite with oxidized developer) may be represented as second-order reactions. Furthermore, the concentrations of reagents are such that the oxident and coupler are in excess of the developer. Under these conditions, the following expression is obtained for the rate constant of the coupling reaction:

$$k=k'\ln[a/(a-x)]/\ln[b/(b-c+x)]$$

where k' is the sulfonation rate constant, a is the concentration of coupler, b is the concentration of sulfite, c is the concentration of developer, and x is the concentration of the dye. The rate constant k is taken as a measure of dispersion reactivity. From an independently determined or known value of k' and with this knowledge of all of the other parameters, the rate constant k (called the automated dispersion reactivity analysis, ADRA, rate) is computed.

EXAMPLES

The following examples are intended to be illustrative of the invention and not exhaustive in describing all its forms.

Parts and percentages are by weight unless otherwise indicated.

Examples 1–7

Conventional Milled Dispersion Utilized

The conventional milled dispersions of prior art utilized to demonstrate this invention with their compositions are listed in Table-III, and the designated Examples are 1–7. These were prepared by known conventional milling procedures as illustrated in U.S. Pat. No. 3,860,425 of Ono et al. The particle size of such milled prior art dispersions are usually broad and were on the average of diameter of about 200 nm as measured by SFFF as indicated earlier.

Examples 8–28

Effect of the Surfactants of Table V on the Low and High Humidity Keeping of a Model Single Layer Magenta Ektacolor Paper Coating In order to determine the effect of the class-A and class-B surfactants of Table-I on the most yellowing prone magenta layer containing magenta dye-forming coupler (C-2), magenta monochrome coatings were prepared according to the coating structure of Table-II with layers 7, 6, 4, and 3 over the standard support. These coatings were prepared with surfactant (S-23) as the coating aid in all cases. Examples 31 and 32 were control coatings with no additional surfactant. All coating melts were prepared to coat 10 sq. ft. The coatings of Examples 8–30 were all spiked with 230 mg of the (dry) surfactants of Table-V, as indicated in Table IV. Therefore, each coating had 23 mg per sq. ft. of (dry) surfactant of test. The other dispersions used in these coatings were those of Examples 2, 4, and 8 as indicated in Table-III.

TABLE III

Compositions of Conventional Dispersions Used in Model EKTACOLOR Paper Coatings

| Example | Compound | Compound Wt. % | Coupler Solvent | Wt. % of Coupler Solvent | Surfactant | Wt. % of Surfactant | Stabilizer Compd. | Wt. % of Stab. Compd. | Wt. % of Gelatin | Wt. % of Water | Comments |
|---|---|---|---|---|---|---|---|---|---|---|---|
| 1 | (C-1) | 12.9 | (SV-1)<br>(SV-2) | 3.2<br>3.2 | (S-23) | 0.9 | None | None | 8.8 | 71.0 | Yellow coupler dispersion in Layer 1 of Tab-II |
| 2 | (C-2) | 8.7 | (SV-1) | 8.7 | (S-23) | 1.0 | (ST-1)<br>(SC-1) | 3.7<br>0.9 | 8.7 | 76.2 | Magenta coupler dispersion in Layer 3 of Tab-II |
| 3 | (C-3) | 9.5 | (SV-1)<br>(SV-2) | 5.2<br>0.8 | (S-23) | 0.7 | (SC-1) | 0.03 | 9.5 | 75.1 | Cyan coupler dispersion in Layer 5 of of Tab-II |
| 4 | (UV-2)<br>(UV-1) | 11.8<br>2.1 | None | None | (S-23) | 0.5 | (SC-1) | 1.7 | 7.8 | 75.7 | UV absorbing dispersion in Layers 4 & 6 of Tab-II |
| 5 | (SC-1) | 6.0 | (SV-1) | 18.0 | (S-23) | 0.2 | None | None | 9.0 | 66.8 | Scavenger dispersion in Layers 2 and 7 of Table-II |

It is to be noted that the dispersion of Example-4 does not contain any coupler solvent. The compounds (UV-1) and (UV-2) at elevated temperatures form an utectic mixture that is liquid and the mixture can be dispersed in aqueous gelatin solution like other conventional dispersions.

TABLE IV

4-Week Wet Oven (60° C/70% RH) Yellowing (WOY) and Dry Oven (77° C/15% RH) Yellowing (DOY) With Various Surfactant Spikes in Magenta Monochrome Model EKTACOLOR Paper Coating

| Example | Surfactant of Table-I | Mg of Surfactant Added to Coat 10 $ft^2$ | Total Moles of Surfactant in 10 $ft^2$ of Coating $\times 10^4$ | Number of Ether Linkage Per Surfactant Molecule | Moles of Ether Linkage in Coating From Added Surfactant Per $ft^2$ | Gain* in Blue D-min After Wet Oven Treatment | Gain* in in Blue D-min After Dry Oven Treatment |
|---|---|---|---|---|---|---|---|
| 8 | (S-1) | 230 | 7.99 | 0 | 0.000 | 0.02 | 0.04 |
| 9 | (S-2) | 230 | 5.18 | 0 | 0.000 | 0.05 | 0.02 |
| 10 | (S-3) | 230 | 3.60 | 0 | 0.000 | 0.00 | 0.01 |
| 11 | (S-4) | 230 | 3.05 | 7 | 0.213 | 0.10 | 0.06 |
| 12 | (S-5) | 230 | 11.2 | 0 | 0.000 | 0.00 | 0.10 |
| 13 | (S-6) | 230 | 7.85 | 0 | 0.000 | 0.00 | 0.02 |
| 14 | (S-7) | 230 | 6.39 | 1 | 0.064 | 0.00 | 0.04 |
| 15 | (S-8) | 230 | 2.40 | 11 | 0.264 | 0.10 | 0.03 |
| 16 | (S-9) | 230 | 4.96 | 5 | 0.248 | 0.08 | 0.04 |
| 17 | (S-10) | 230 | 2.82 | 13 | 0.366 | 0.14 | 0.11 |
| 18 | (S-11) | 230 | 2.31 | 10 | 0.231 | 0.10 | 0.05 |
| 19 | (S-12) | 230 | 2.45 | 10 | 0.245 | 0.02 | 0.05 |
| 20 | (S-13) | 230 | 3.28 | 6 | 0.197 | 0.10 | 0.07 |
| 21 | (S-14) | 230 | 5.75 | 2.2 | 0.126 | 0.00 | 0.02 |
| 22 | (S-15) | 230 | 4.26 | 8.5 | 0.362 | 0.11 | 0.07 |
| 23 | (S-16) | 230 | 3.13 | 13 | 0.407 | 0.13 | 0.04 |
| 24 | (S-17) | 230 | 4.28 | 9 | 0.385 | 0.10 | 0.12 |
| 25 | (S-18) | 230 | 3.22 | 13 | 0.419 | 0.12 | 0.05 |
| 26 | (S-19) | 230 | 1.92 | 24 | 0.461 | 0.14 | 0.03 |
| 27 | (S-20) | 230 | 5.13 | 4 | 0.205 | 0.08 | 0.07 |
| 28 | (S-21) | 230 | 3.68 | 8 | 0.295 | 0.12 | 0.12 |
| 29 | (S-22) | 230 | 2.36 | 16 | 0.377 | 0.16 | 0.10 |
| 30 | (S-23) | 230 | 8.84 | 0 | 0.000 | 0.00 | 0.00 |
| 31 | None | | CONTROL | | | −0.01 | 0.00 |
| 32 | None | | CONTROL | | | 0.00 | 0.00 |

*The raw WOY for controls 24 and 25 were 0.09 and 0.10, respectively. All the WOY were reported with the control average of 0.10 subtracted from the raw values and rounded to two significant figures.
The raw DOY for controls 24 and 25 were 0.06 and 0.06, respectively. All the DOY values were reported with the control average of 0.06 subtracted from the raw values and rounded to two significant figures.

The coatings were processed in an RA4 process in a sinkline apparatus.

The fresh sensitometric curves of all the coatings, within experimental error, appeared identical in terms of speed, Dmax, Dmin, and contrast.

The image keeping tests performed on these processed coatings were as follows:

1. 2-week 50 Klux daylight (color temperature of source balanced for daylight) printout (i.e., ΔD (blue) from Dmin)
2. 2-week 50 Klux daylight fade from 1.0 initial density
3. 2- and 4-week dry oven (77° C./15% RH) fade from 1.0 initial density
4. 2- and 4-week 60° C./70% RH gain in blue Dmin–Wet Oven Yellowing (WOY)
5. 2- and 4-week 77° C./15% RH gain in blue Dmin–Dry Oven Yellowing (DOY)

Tests 1 and 3 did not indicate major differences for the test coatings compared to the controls and, hence, will not be a subject for the discussion. The wet and dry oven yellowing characteristics of coatings with the test surfactants were widely different and are discussed below.

The four-week wet oven (60° C./70% RH) yellowing results for coating Examples 8–32 are listed in Table IV. The raw WOY value for control Examples 31 and 32 were 0.09 and 0.10, respectively. All of the WOY values were reported with the control average of 0.10 subtracted from the raw values and rounded to two significant figures.

Figure 8:
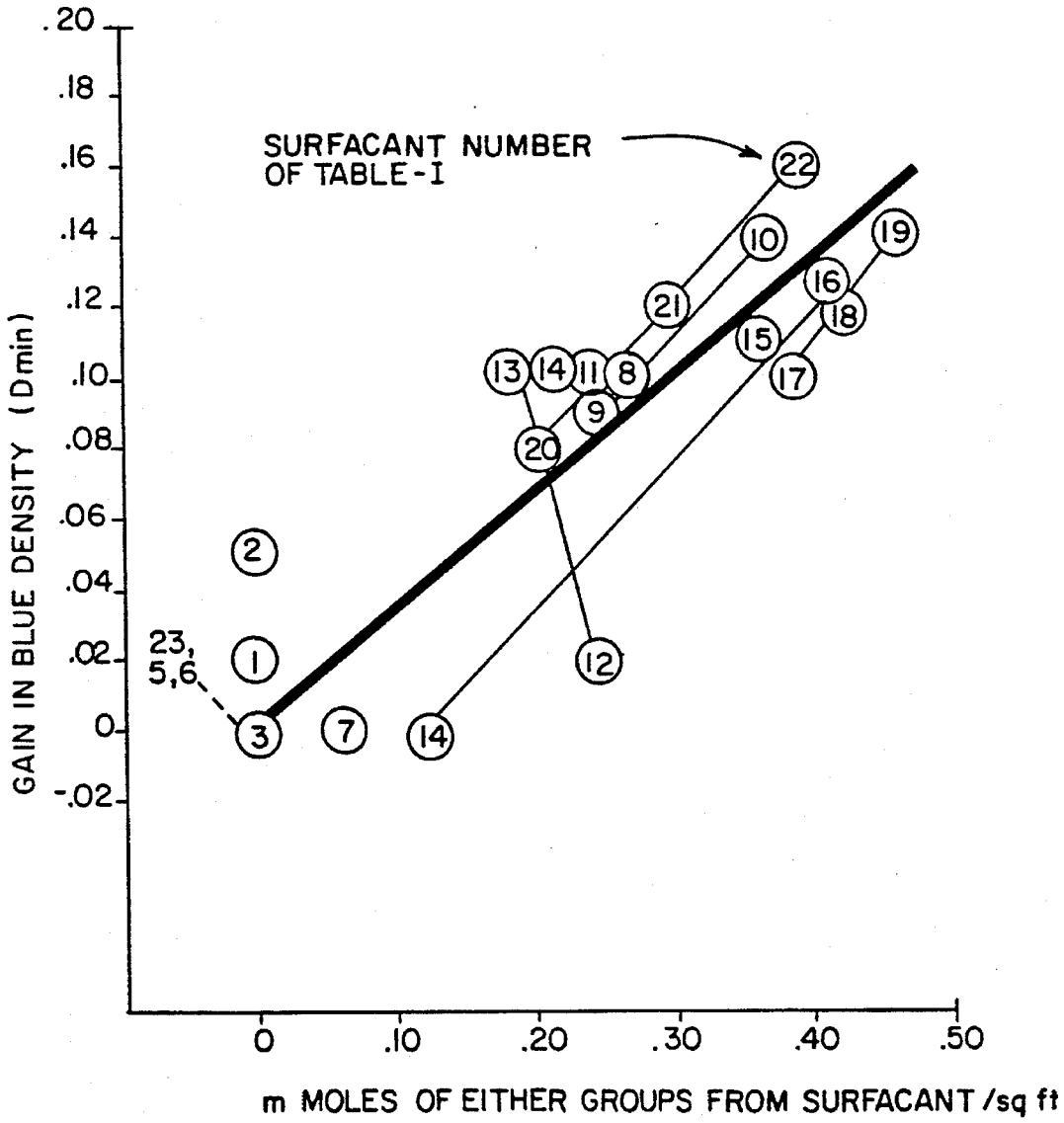
FIG. 8 wet oven (60° C./70% RH) yellowing of the 22 test surfactants plotted as a function of the molar surface coverage of ether linkages in the coating arising from the spiked-in surfactant.

FIG. 8 shows a plot of the wet oven gain in blue Dmin as a function of the mmoles of ether groups for surfactant per sq. ft. of coating. Even though there is some scatter, it is clear that there is a trend for increased wet oven yellowing with increased molar laydown of ether linkage from surfactant per unit area of coating. The thick line marks a global correlation of all of the data. The thinner lines show the correlations in the individual classes of surfactants where the length of the ether or glycidyl ether chains were varied. In all of the classes of surfactants, the correlation of each of the homologous series are excellent except for the case of the two Mazol surfactants. This might be due to impurities that are associated with these commercial surfactants. The surfactants that show little or no incremental yellowing are primarily class-A surfactants such as:

1. Sodium Dodecyl Sulfate (S-1)
2. Aerosol OT (S-2)
3. Aerosol 22 (S-3)
4. Octyl Hydroxyethyl Sulfoxide (S-5)
5. Triton TX-200E and (S-14)
6. Alkanol XC (S-23)

These are chosen for WOY being less than 0.05 above the controls. Even though Mazol PG-L101 satisfies this criterion, it was not chosen; as will be seen later, it has a DOY value larger than 0.05 over the controls. Among the six favorable surfactants, only Triton TX-200E is an ethoxylated surfactant. But, among all of the ethoxylated surfactants used, it has the least degree of ethoxylation, about 2.2 ether linkages per mixture mole (see Tables I and IV). In other words, the results suggest that ethoxylated surfactants of Type 13 may not be usable in Ektacolor paper with (C-2) as the magenta coupler.

Wet-oven yellowing in the magenta layer of Ektacolor paper is probably due to radical-induced oxidative dimerization of Coupler (C-2). Since compounds containing ether linkages are recognized to generate peroxide radicals, the correlation of WOY with coverage of ether groups is consistent with the hypothesis that the incremental yellowing is due to radicals generated from the ether linkages in the ether-containing surfactants.

The two-week WOY results were qualitatively similar to the four-week tests but lower in effect, as expected.

The four-week dry oven (77° C./15% RH) results are also listed in Table IV. The raw DOY values for control Examples 31 and 32 were 0.06 and 0.06, respectively. All of the DOY values were reported with the control average of 0.06 subtracted from the raw values and rounded to two significant figures.

Figure 9:
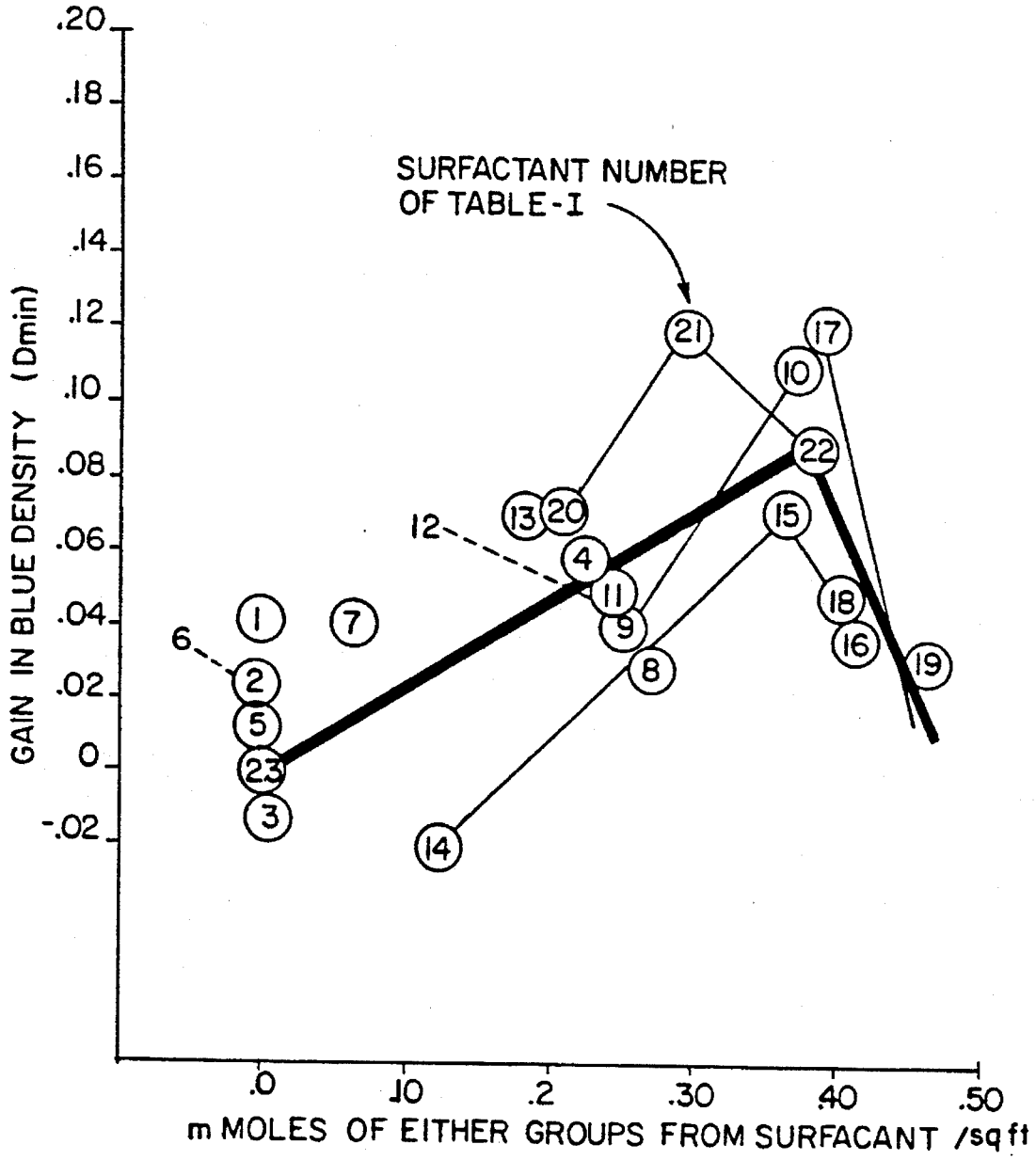
FIG. 9 dry oven (77° C./15% RH) yellowing of the 22 test surfactants plotted as a function of the molar surface coverage of ether linkages in the coating arising from the spiked-in surfactant.

The results are plotted in FIG. 9 as a function of mmolar coverage of ether linkages from the spiked surfactants. In the global correlation there is an initial rise of yellowing as a function of ether linkage coverage. After about 0.4 mmoles of ether linkage per sq. ft. there appears to be a drop in yellowing. The individual homologous series (except the Mazols, like before) also seem to behave in a similar manner. If we examine the individual homologous series, we see the discontinuity occurring around eight oxyethylene groups.

If the above trend is, in fact, real, then a possible explanation involves the helical structure or the polyoxyethylene of the polyglycidyl ether chains. It seems that a stable helix can only form with about eight oxyethylene groups. This is probably why DOY falls off beyond about eight oxyethylene groups. Under dry oven conditions, where the helices are more stable beyond eight oxyethylene groups, peroxide formation may be more difficult, in the presence of moisture, the water molecules can probably aid the unraveling of the helix through hydrogen bonding. However, reduced dry oven yellowing beyond eight oxyethylene groups is not an advantage in product building, since WOY still keeps on increasing (FIG. 7) at such coverages.

Even though these coatings are monochrome coatings, the results clearly indicate that class-B surfactants that contain ether linkages produce keeping yellow Dmin on keeping with magenta coupler (C-2) of EKTACOLOR paper. Even if such surfactants were present in other layers such as the yellow layer, they would diffuse with time and during processing into the magenta layer and cause adverse yellow stain problems with keeping. Therefore, it is essential to minimize type B surfactants from photographic systems that contain coupler (C-2) as the magenta dye-forming coupler.

Examples 29–35

Particle Size Dependence of the Activity of Yellow Coupler (C-1) in Model Monochrome EKTACOLOR Paper Coating Prior art microprecipitated dispersion of coupler (C-1) was prepared at small scale using the equipment of FIG. 7. The various components and the solutions used for the preparation of two sets of dispersions, one using sodium dodecylsulfate (SDS, S-1) and polyvinylpyrrolidone as the dispersion stabilizer, and the second set using Aerosol A102 (S-24) as the stabilizer. The particle size of these dispersions were varied by varying the concentration of coupler (C-1) during precipitation. The higher the precipitation concentration of the coupler, the larger is the size of the dispersion particles. The precipitation process is described in the following paragraph:

The process utilizes the semicontinuous pH-controlled coupler precipitation apparatus described in FIG. 7. This apparatus produced about 800 ml of dispersion.

| | | |
|---|---|---|
| Coupler solution: | Coupler (C-1) | 20 g |
| | 20% NaOH | 5 g |
| | n-propanol | 40 g |
| | | 65 g |

Above ingredients mixed together and heated to 60° C. with stirring to dissolve the coupler and then cooled to room temperature in a separate vessel (not shown) in FIG. 7 and added to the coupler kettle 100. The surfactant solution in each preparation example was prepared according to the formulation prepositions shown in Table-V. For preparation of each dispersion, the surfactant was added in the reaction kettle 104 of FIG. 7 and stirred to mix. The acid kettle filled with 15% propionic acid. Stirrer 116 was maintained at 2000 rpm. The basic coupler solution was pumped into the reaction kettle at 20 mg/min. The pH-controller was set at 6.0, which controlled the pH by turning the acid pump on as the pH went over 6.0, and off as the pH fell below 6.0. In effect, pH was controlled to 6.0±2 as determined the strip chart recorder 130. Precipitations were carried out at room temperature. After precipitation the resultant dispersions were washed by dialysis against distilled water for 24 hours.

The particle sizes of the formed dispersions are also shown in Table-V. It is observed that increase of the concentration of coupler (C-1) during precipitation increased the particle diameter of the formed dispersions. The final concentrations of the coupler after diafiltration purification were determined by high pressure liquid chromatographic (HPLC) and are also listed in Table-V.

TABLE V

Preparation of Dilute Microprecipitated Dispersions of Coupler (C-1)

| | Coupler Solution | | | Surfactant Solution | | | | | | | |
|---|---|---|---|---|---|---|---|---|---|---|---|
| Example | Wt. of Coupler (C-1)(g) | Propanol (g) | 5% NaOH in $H_2O$ (g) | SDS[1] (g) | PVP[2] (g) | Surfac. (S-24) 33% in $H_2O$ (g) | Water (g) | Precipitation Conc. of (C-2)(%) | Final (C-2) Conc. After Dialysis (%) | D (PCS) (mm) | Blue Dmax |
| 29 | 20 | 40 | 5 | 3 | 10 | 0 | 400 | 4.0 | 2.5 | 8 | — |
| 30 | 20 | 40 | 5 | 3 | 10 | 0 | 300 | 5.0 | 3.2 | 18 | 2.25 |
| 31 | 20 | 40 | 5 | 3 | 10 | 0 | 200 | 6.7 | 3.8 | 100 | 1.52 |
| 32 | 20 | 40 | 5 | 0 | 0 | 15 | 400 | 4.0 | 2.5 | 14 | 2.18 |
| 33 | 20 | 40 | 5 | 0 | 0 | 15 | 300 | 5.0 | 3.3 | 13 | 2.15 |
| 34 | 20 | 40 | 5 | 0 | 0 | 15 | 200 | 6.7 | 4.0 | 72 | 1.20 |
| 35 | Conventional Milled Dispersion of Coupler (C-1) of Example-1 (Control) | | | | | | | | | | 2.07 |

Silver chloride coverage in all coatings were 23 mg per sq. ft.
[1]SDS - Sodium dodecyl sulfate.
[2]PVP - Polyvinyl pyrrolidone.

Each dispersion was then coated in a yellow model monochrome EKTACOLOR paper coating format that contained layers 7, 6, 4, and 1 over the standard resin coated paper base of Table-II. The blue sensitive AgCl emulsion in this set was coated at 23 mg per sq. ft. A control experiment, using the high boiling coupler solvent containing prior milled dispersion, was also coated at an identical AgCl and coupler (C-1) coverage (Example-35). It is to be noted that all these dispersions were coated at a very low concentration of about 2% of coupler in the coating melt. At such low concentration of the coupler in the melt no viscosity problem is usually encountered. Therefore, no viscosity control surfactant was added to the melt. The coatings, however, were prepared with standard spreading agents usually used to prepare photographic coatings. These coatings were exposed and processed by RA4 processing as indicated earlier. The activity of such coatings as indicated by the Dmax values are also listed in Table-V. The coating strip of Example-29 was lost and, hence, the Dmax value is missing for this example in Table-V.

The Dmax values of the microprecipitated dispersions, containing no coupler solvent, clearly indicate that smaller particles produced coatings with higher activity at the same coupler and silver coverage. It is seen from the Dmax values compared to the conventional control that the microprecipitated dispersions that had diameters less than about 20 nm are the only dispersions that produced Dmax values larger than the conventional control. Therefore, only those types of microprecipitated dispersions of prior art of coupler (C-1) that have particle diameters less than about 20 nm constitute a component of the dispersion melt of this invention.

Examples 36–49

Preparation of Concentrated Large Scale Microprecipitated Dispersions of the Yellow Coupler (C-1)

The preparation of microprecipitated dispersions of yellow coupler (C-1) with particle diameter less than at least 20 nm utilizes a process and apparatus generally as schematically illustrated in FIG. 6. The coupler solution, surfactant solution, and acid solution are prepared as follows:

| | | |
|---|---|---|
| Coupler solution: | Coupler (C-1) | 3000 g |
| | 20% NaOH | 750 g |
| | n-propanol | 7500 g |
| | | 11250 g |
| | Flow rate: | 547 g/min |

Above ingredients were mixed together and heated to 55° C. to dissolve the coupler and then cooled to 30° C. before use.

| | | |
|---|---|---|
| Surfactant solution: | High purity water | 45000 g |
| | Aerosol A102 (33%) | 2250 g |
| | (American Cyanamid) (S-24) | 47250 g |
| | Flow rate: 3030 g/min | |
| Acid solution: | Propionic acid | 375 g |
| | High purity water | 2125 g |
| | | 2500 g |
| | Flow rate: | Approximately 106 g/min (adjusted to control the pH of the dispersion between 5.9 to 6.1). |

The description of the apparatus set up for this example is as follows:

Temperature-controlled, open-top vessels

Gear pumps with variable-speed drives

The mixer is a high fluid shear centrifugal mixer operated with a typical residence time of about 2 sec.

A SWAGE-LOC "T" fitting where surfactant and coupler streams join

Residence time in pipe between T-fitting and mixer is <<1 sec.

In-line pH probe is used to monitor pH in the pipe exiting the mixer

Positive displacement pump for recirculation in batch ultrafiltration

Ultrafiltration membrane is OSMONICS 20K PS 3' by 4" spiral-wound permeator

Process Description

The three solutions are continuously mixed in the high-speed mixing device in which the ionized and dissolved coupler is reprotonated causing precipitation. The presence of the surfactant stabilizes the small particle size dispersion. The salt byproduct of the acid/base reaction is sodium propionate. Ultrafiltration is used for constant-volume washing with distilled water to remove the salt and the solvent (n-propanol) from the crude dispersion. The recirculation rate is approximately 20 gal/min. with 50 psi back pressure which gives a permeate rate of about 1 gal/min. The washed dispersion is also concentrated by ultrafiltration to the desired final coupler concentration of about 10–15 weight percent. The time to perform the ultrafiltration and produce the final coupler concentration is about 1 hour.

Six identical microprecipitated dispersions of coupler (C-1) were prepared in this manner as indicated in Table-VI and identified as Examples 36–41, It is seen that all the dispersions had average particle diameters well below 20 nm to produce high activity in the coated format as determined earlier. It is also seen that the process produces very reproducible particle sizes for preparation to preparation. The similarity of the ADRA solution reactivity rates of all these dispersions also testify to their reproducibility. It is also seen in Table-VI that the coupler solvent containing conventional milled dispersion of coupler (C-1) produced ADRA reactivity rate about 10 times smaller than those of the microprecipitated dispersions, verifying the high reactivity of the microprecipitated small particle dispersions that are a component of this invention.

TABLE VI

Physical Properties of Microprecipitated Dispersions of Coupler (C-1)

| Dispersion Example | Particle Diameter in nm by PCS | ADRA Reactivity Rate in 1/(mole × sec.) |
|---|---|---|
| 36 | 14 | 13400 |
| 37 | 15 | 12000 |
| 38 | 16 | 13700 |
| 39 | 16 | 14600 |
| 40 | 13 | 12600 |
| 41 | 16 | 13700 |
| (conventional control) | — | 1250 |

Examples 41–48

Rheology of Gelatin Dispersion Melts of Microprecipiatated Dispersions of Coupler (C-1)

Example 41

The microprecipitated control gelled dispersion of Example 36 was prepared as follows: Generally when a polymer such as gelatin is added to a concentrated fine particle dispersion. The dispersion is added to the polymer solution such that when the particles contact the gel solution, there is excess polymer compared to the particles and the polymer adsorb around the particles to sterically protect the dispersed particles from bridging floculation. (See, for example, P. Bagchi, J. Colloid and Interface Science, Vol. 47, pages 86 and 110, 1974; Vol. 41, page 380, 1972; and Vol. 50, page 115, 1975). Based upon such prior knowledge, the gel melt was prepared by heating an appropriate concentration and amount of gelatin solution to 60° C. in a vessel with a paddle stirrer and then adding the appropriate microprecipitated dispersion of Example 36, at 60° C., such that the final melt would contain 8% coupler (C-1) and 5% gelatin. A clear dispersion was formed indicating unfloculated dispersion. The viscosity of this melt was measured at 50° and at 66 reciprocal seconds as indicated earlier and was found to be 182 cp. The pH of such a melt was about 5.5. At such a high viscosity, the melt was uncoatable in a multilayer coating as indicated in Table-II. Generally, a melt viscosity less than 30 cp is desirable. The viscosity values of all the melts described in this section are listed in Table-VII.

TABLE VII

Viscosity and Multilayer Coatability of Control, Comparison and Inventive Melts of Dispersions Containing 8% Coupler (C-1) and 5% Gelatin

| Melt Example | Dispersion (Example) | % of Viscosity Control Surfactant (S-24) of Prior Art Added per g of Coupler (C-1) | Viscosity Control Surfactant (SI-1) of Invention Added per g of Coupler (C-1) | Viscosity at 50° C. and 66 $sec^{-1}$ in CP | Comment on Multilayer Coatability |
|---|---|---|---|---|---|
| 41 | Microprecipitated (36) | 0.0 | 0.0 | 182 | Uncoatable |
| 42 | Microprecipitated (36) | 0.2 | 0.0 | 82 | Uncoatable |
| 43 | Microprecipitated (36) | 0.4 | 0.0 | 30 | Barely Coatable |
| 44 | Microprecipitated (36) | 0.6 | 0.0 | 12 | Easily Coatable |
| 45 | Microprecipitated (36) | 0.0 | 0.2 | 17 | Easily Coatable |
| 46 | Microprecipitated (36) | 0.0 | 0.4 | 9 | Easily Coatable |
| 47 | Microprecipitated (36) | 0.0 | 0.6 | 6 | Easily Coatable |

TABLE VII-continued

| Viscosity and Multilayer Coatability of Control, Comparison and Inventive Melts of Dispersions Containing 8% Coupler (C-1) and 5% Gelatin | | | | | |
|---|---|---|---|---|---|
| Melt Example | Dispersion (Example) | % of Viscosity Control Surfactant (S-24) of Prior Art Added per g of Coupler (C-1) | Viscosity Control Surfactant (SI-1) of Invention Added per g of Coupler (C-1) | Viscosity at 50° C. and 66 $sec^{-1}$ in CP | Comment on Multilayer Coatability |
| 48 | Conventional Milled (1) | 0.0 | 0.0 | 26 | Easily Coatable |

The microprecipitated dispersion of Example-36 was prepared using prior art surfactant (S-24) and the conventional milled dispersion of prior art was prepared using surfactant (S-23).

Examples 42–44

These examples pertain to the control of viscosity of gelatin melts containing microprecipitated dispersion of coupler (C-1) using the prior art surfactant (S-24). In preparation of these comparative examples, it was found that conventional methods of addition of microprecipitated dispersions to gelatin solutions containing surfactant led to bridging flocculation and turbidity increase. The reason for this was not well understood. However, when the gelatin solutions containing surfactants were quickly added to the microprecipitated dispersions, clear dispersion melts were obtained. Therefore, these melts were prepared by the addition of the gelatin solution at the appropriate concentration and amounts at 60° C., to the microprecipitated dispersions of the appropriate amount of Example 36 with stirring at a rate of about 1 kg per minute to form gelatin melts that contained 8% coupler (C-1) and 5% gelatin. In preparation of melts of Examples 42, 43, and 44, respectively 0.2, 0.4, and 0.6 g of the prior art surfactants (S-24) per g of coupler (C-2) was used in the gelatin solution. The measured viscosity values are again shown in Table-VII. It is seen that the melt of Example 42 containing 0.2 g of surfactant (S-24) per g of coupler (C-2) had a viscosity of 82 cp, which was much too high for coatability in a multilayer format. The melt of Example 43 which had a viscosity of 30 cp was barely coatable and that of Example 44 which had a viscosity of 12 cp was easily coatable. However, when coated in a full three-color multilayer format as shown in Table-II, the melts of Examples 43 and 44 containing excessive amounts of the prior art ethoxylated surfactant (S-24) showed excessive yellowing upon incubation in the presence and absence of light, especially under high humidity. It is to be noted that, in the earlier Examples 8–32, it was shown use of excessive amounts of ethoxylated surfactants in combination with magenta coupler (C-2) produces excessive yellowing. As the microprecipitated dispersion of Example 36 was also prepared with the ethoxylated surfactant (S-24), the melts of Examples 43 and 44 showed such unacceptable yellowing in the presence of such high amounts of the ethoxylated surfactant (S-24) of prior art. It is surmised that during development and keeping the ethoxylated surfactant diffused to the magenta layer that contained coupler (C-1) and produced such unacceptable yellowing. Therefore, it is clear that use of the surfactant (S-24) of prior art is unusable in EKTACOLOR paper systems.

Examples 45–47

These examples pertain to the control of viscosity of gelatin melts containing microprecipitated dispersions of coupler (C-1) using the invention surfactant (SI-1). In the preparation of these dispersion melts, it was also found that addition of surfactant containing gelatin to the microprecipitated dispersions produced unflocculated dispersion melts. Therefore, these melts were prepared to contain 8% coupler using the microprecipitated dispersion of Example 36 and 5% gelatin with 0.2, 0.4, and 0.6 g of the inventive surfactant (SI-1) according to the following inventive procedure. The invention surfactant (SI-1) used was alkylpolyglycoside with structure as indicated earlier with n=8 to 10 and x=1.8. The surfactant is commercially sold by Henkal Corporation.

Step 1:

Appropriate quantity of the concentrated microprecipitated dispersion of Example 36 was heated with stirring to 60° C.

Step 2:

Appropriate quantity of gelatin surfactant and water were mixed together with stirring at 60° C. to produce the gelatin solution.

Step 3:

The gelatin/surfactant solution was added to the stirred microprecipitated dispersion at the rate of about 10 per minute.

Figure 10:
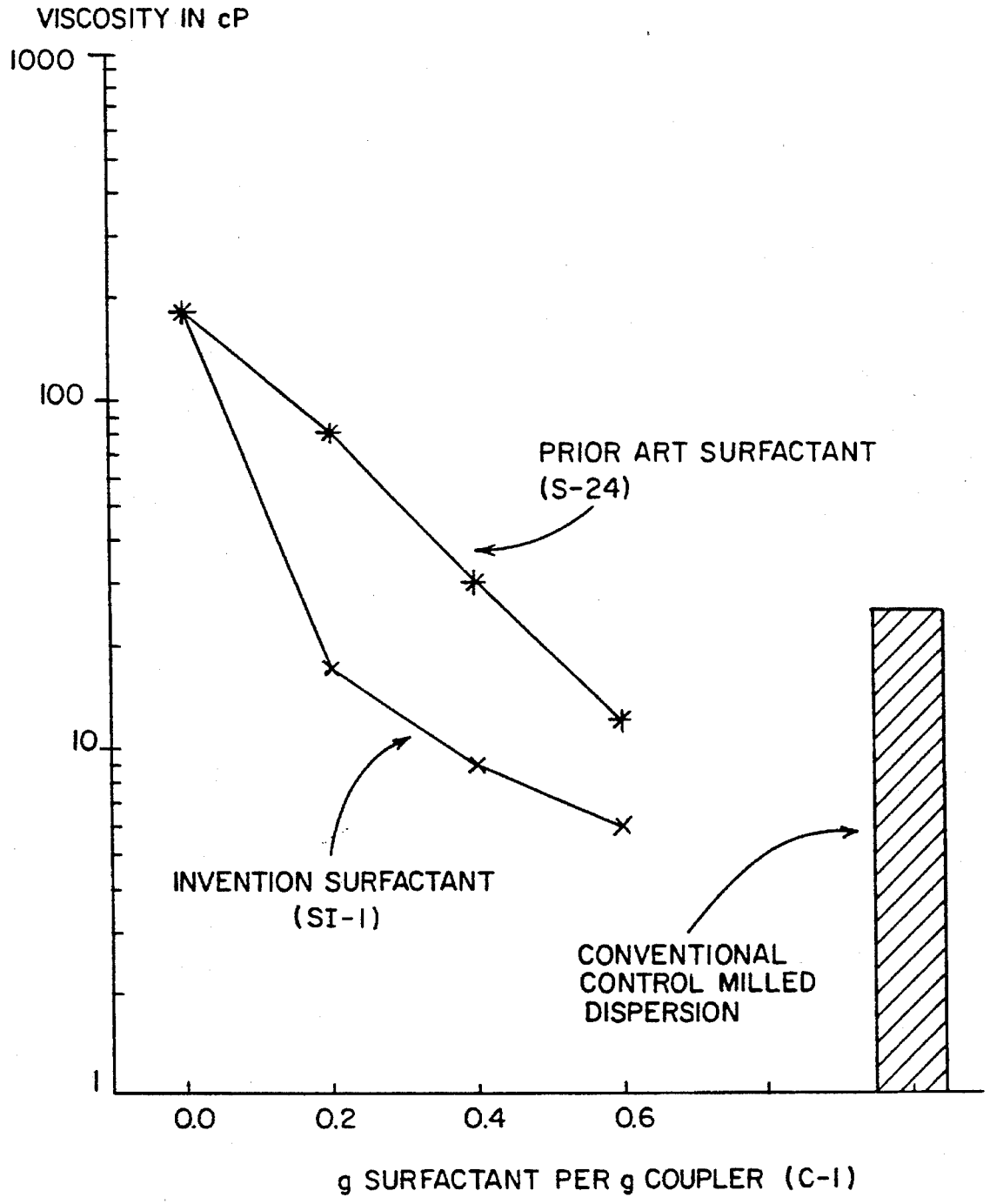
FIG. 10 viscosity of dispersion melts made up with gel (5%) microprecipitated dispersion of coupler (C-1) (8%) and surfactant at 66 $sec^{-1}$, 50° C. and pH=5.5.

The resulting gelatin melts of Examples 45, 46, and 47 containing respectively 0.2, 0.4, and 10.6 g of the invention surfactant (SI-1) per g of coupler (C-1) formed clean dispersion melts. The viscosity of these melts were measured at 50° C. and are shown in Table-VII. It is seen that all these dispersions had viscosity of 17 cp or less at this temperature. FIG. 10 shows plots of the viscosity of the melts of Examples 41–47 as functions of the weight of either the prior art surfactant (S-24) or the invention surfactant per g of coupler (C-1). It is clearly seen from these plots of FIG. 10 and Table-VII that it took about three times as such of the prior art surfactant (S-24) compared to the invention surfactant (SI-1) to produce an 8% coupler 5% gelatin melt that had coatable viscosity of about 25 cp or less.

Example 48

The prior art large particle milled dispersion of Example 1 of coupler (C-1) was diluted with the appropriate amount of gelatin solution at the appropriate gelatin concentration to produce a melt containing 8% coupler and 5% gelatin. The viscosity of such a control melt was also determined at 50° C. to be 25 cp and is also shown in Table-VII and FIG. 10. As expected, such very low viscosity conventional dispersion was easily coatable on a multilayer slide hopper coating machine.

Examples 49 and 50

Photographic Evaluation of the Inventive Dispersion Melt of Example 45 in Comparison With the Coventional Milled Dispersion Melt of Example 1

The inventive dispersion melt of Example 45 and the control conventional dispersion melt of Example 1 of the yellow coupler (C-1) were coated in the full multicolor EKTACOLOR paper format of Table-II using the necessary dispersions of Table-III. The coatings were exposed and processed as indicated earlier. The sensitometry of the fresh and incubated the (unprocessed raw stock) films are shown in Table-VIII. It is seen in the fresh sensitometry that the inventive dispersion produced much higher Dmax testifying to its high activity. It also exhibited a much larger contrast compared to the conventional control testifying to the higher reactivity of the dispersion melt of this invention. The invention coating of Example 49 produced the same Dmin as the control. In the raw stock incubation of the inventive coating produced much smaller speed gain and contrast loss compared to the control example. The invention example, however, produced a slightly greater blue Dmin gain, but such small increase is quite acceptable for commercialization. In separate coatings not shown in the examples, it was found that the invention example produced the same Dmax values as controls containing milled large particle dispersion at 12.5% less silver coverage. This constitutes a large savings in high volume products, such as EKTACOLOR paper or EASTMAN COLOR PRINT products (EASTMAN COLOR PRINT in a trademark of the Eastman Kodak Co.). It was also estimated from these coatings that a reduction of about 15% coupler could be achieved using the invention melt because of its high activity without any loss of Dmax.

The yellow dye stability of the coatings of Examples 49 and 50 were determined under various conditions and are described in Table-IX. These tests were performed after incubation of processed strips as indicated in Table-IX. It is seen in Table-IX that the inventive coating upon dark keeping at 72° C. at 60% RH for four weeks did not lose any yellow dye density at all compared to a loss of 0.12 of the conventional control coating. This is an extremely desirable feature for professional quality photographic paper. At the same time, increase of blue Dmin in both cases were comparable. At a higher incubation temperature of 85° C. and 40% RH for two weeks, the blue density loss for the inventive coating was 0.03 compared to 0.25 for the conventional control. This, again, shows the extremely high dye stability of the inventive coatings. In presence of light exposure also, it is seen in Table-IX that the inventive coating lost only about half the dye density as the control coating.

TABLE VIII

| | | Sensitometry, Fresh and After Raw Stock Incubation of Full Multicolor Coatings | | | | | |
|---|---|---|---|---|---|---|---|
| | | Fresh Sensitometry of the Yellow Record | | | Sensitometry After Raw Stock Keeping at 120° F. and 50% RH | | |
| Example Coating | Coupler (C-1) Melt Example | Dmax | Contrast | Dmin | Speed Gain in Log Exposure | Contrast Loss | Blue Dmin Gain |
| 49 (Invention) | 45 (Inventive) | 2.50 | 2.69 | 0.09 | 0.03 | 0.05 | 0.35 |
| 50 (Control) | 1 (Control) | 2.45 | 2.55 | 0.09 | 0.05 | 0.28 | 0.025 |

TABLE IX

| | Results of Various Dye Stability Tests in Full Multilayer Coatings | | | |
|---|---|---|---|---|
| | Dark Stability Image Incubated For 4 Weeks at 72° C. and 60% RH | | Image Incubated For 2 Weeks at 85° C. and 40% RH. | Light Stability Image Incubated For 2 Weeks Under 50 K Lux Sunshine Temperature Balanced Exposure at 25° C. |
| Example Coating | Change of Blue Density From 0.1 | Increase in Blue Dmin | Change in Blue Density From 0.1 | Change in Blue Density From 1.0 |
| 49 (Inventive) | −0.00 | +0.19 | −0.03 | −0.18 |
| 50 (Control) | −0.12 | +0.19 | −0.25 | −0.31 |

The invention has been described with reference to preferred embodiments. However, it is to be understood that other variations and embodiments of the invention may be performed. For instance, while illustrated with one color photographic systems, it is to be understood that the invention is suitable for all color photographic systems. Further, while generally illustrated with dispersion systems containing 5% gelatin and 8% coupler by weight the surfactants of the invention also are suitable for use with other concentrations of the gelatin and coupler in the emulsion. It is also suitable for small particle film forming dispersions in other than photographic uses; such as medicinal applications in animals or for insecticides. The invention is only intended to be limited by the breadth of the claims attached hereto.

We claim:

1. A photographic dispersion composition comprising a small particle microprecipitated photographic material, gelatin, Type B preparation surfactant wherein Type B is a surfactant whose hydrophobic segment is composed of an aliphatic or aromatic hydrocarbon moiety composed of between 6 to 22 carbon atoms and a hydrophilic segment comprising between 2 to 20 oxyethylene or glycedylether groups with or without termination by a sulfate or a sulfonate group, and at least one of the sugar surfactants

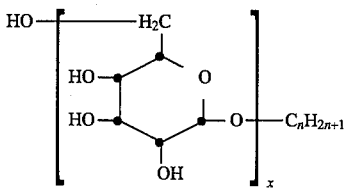

or

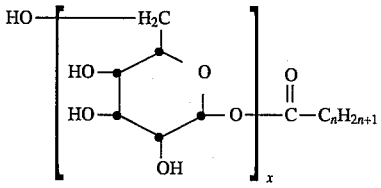

wherein n=5 to 20 and x=1 to 4, and wherein said small particle microprecipitated photographic material comprises coupler material and said small particle microprecipitated photographic material has a particle diameter of less than 100 nm.

2. The composition of claim 1 wherein said photographic material comprises a dye-forming coupler.

3. The composition of claim 2 wherein said coupler comprises

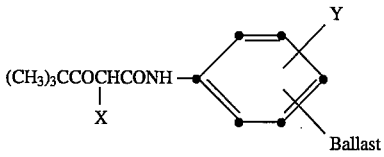

where

X is a suitable leaving group or H

Y is an organic moiety or

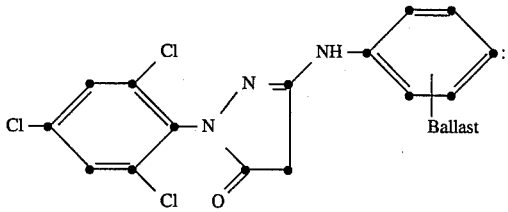

4. The composition of claim 2 wherein said photographic material comprises the yellow dye-forming coupler

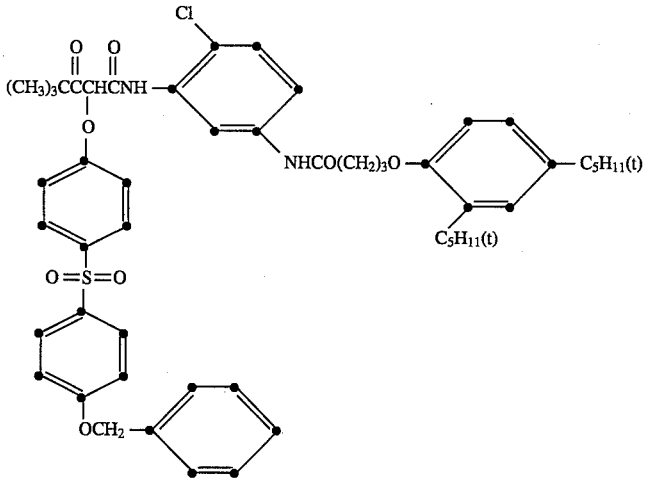

5. The composition of claim 2 wherein said dispersion contains 8% of the dye-forming coupler, 5% of dry gelatin, and the said sugar surfactant is present at a level between 0.1 to 0.3 g per g of the coupler weight.

6. The composition of claim 1 wherein said photographic material comprises (C-2)
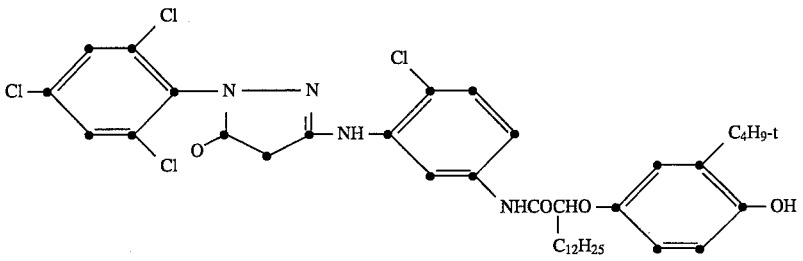
(C-3)
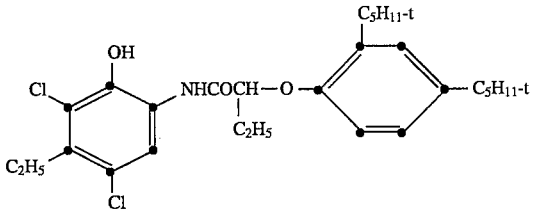
(C-4)
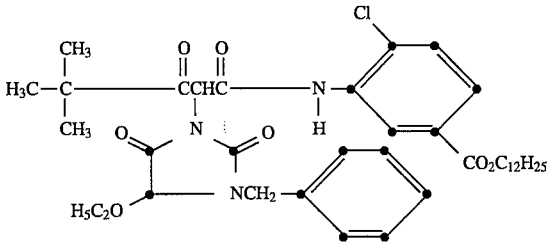
(C-5)
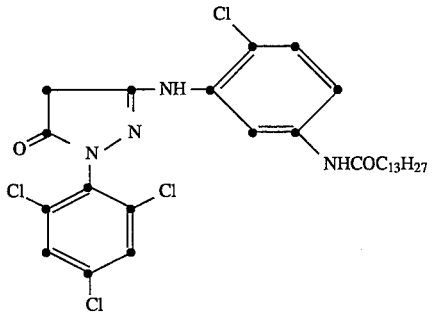
(C-6)
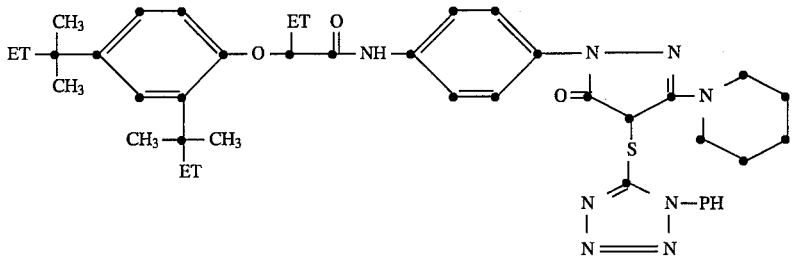
(C-7)
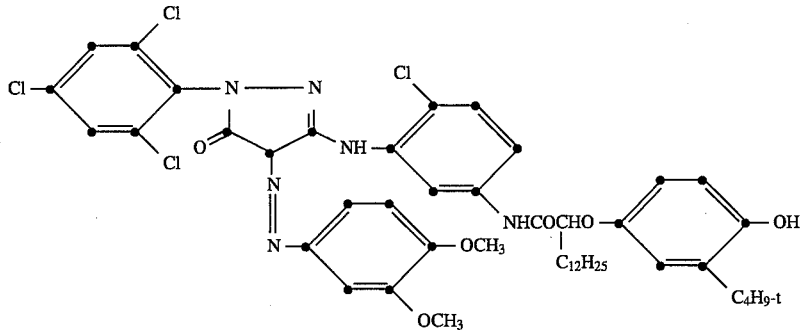

-continued
(C-7A)
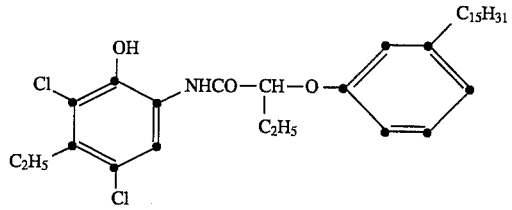
(C-8)
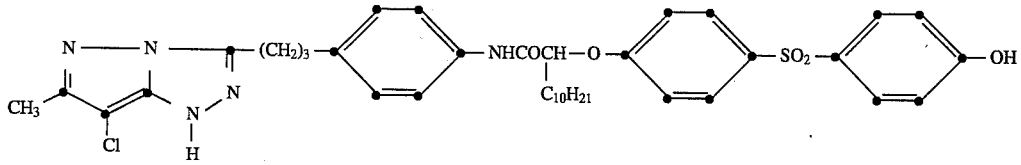
(C-9)
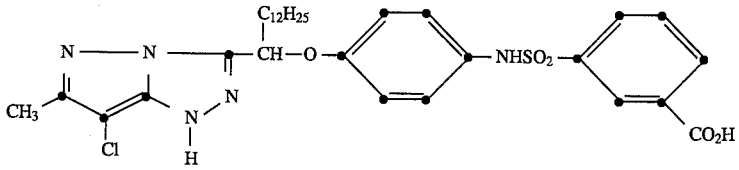
(C-10)
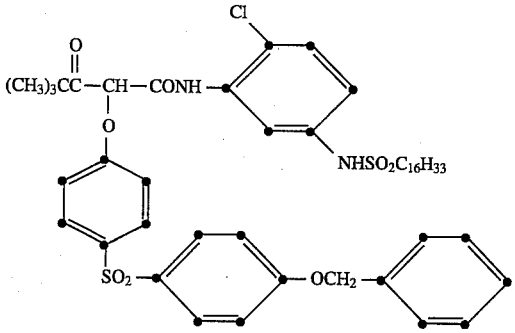
(C-11)
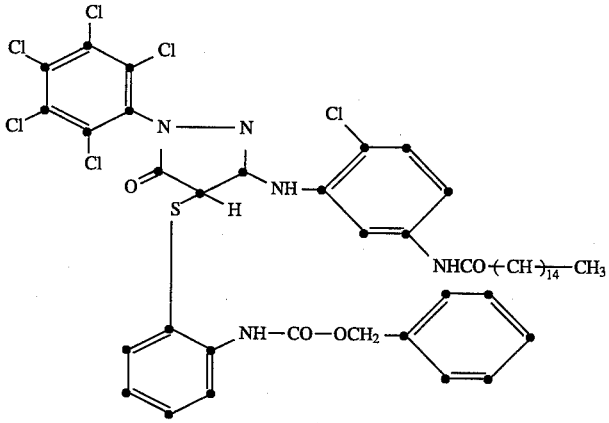
(C-12)
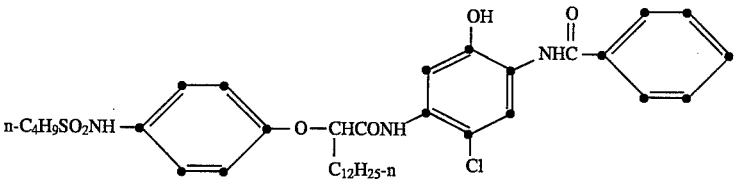

-continued
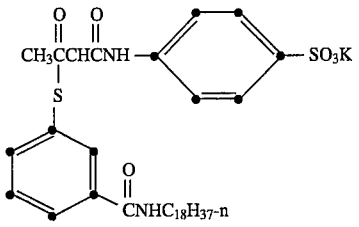
(C-13)
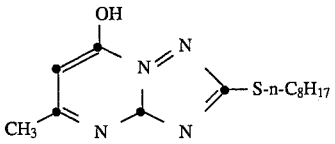
(C-14)
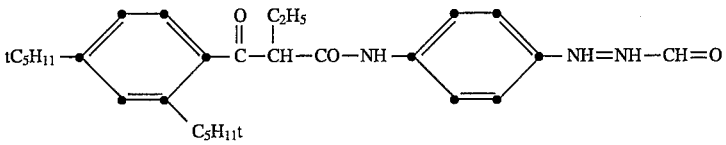
(C-15)
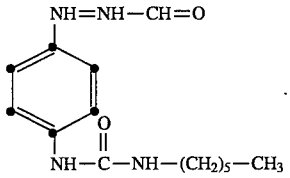
(C-16)
7. The composition of claim 1 wherein the small particle microprecipitated photographic material has a particle diameter less than 20 nm.
8. The composition of claim 1 wherein said dispersion preparation surfactant comprises at least one of the following surfactants:
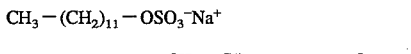
(S-1)
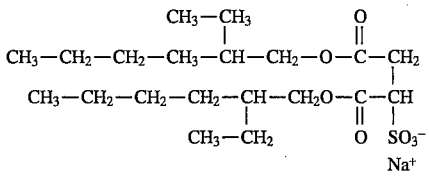
(S-2)
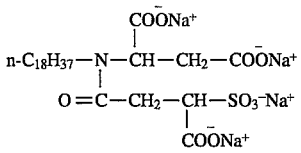
(S-3)
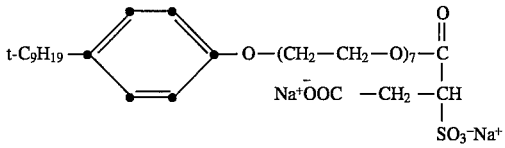
(S-4)
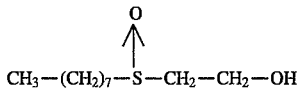
(S-5)
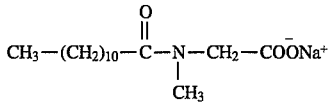
(S-6)

-continued
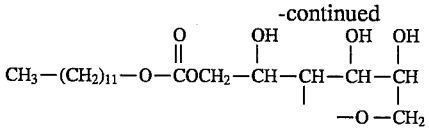
(S-7)
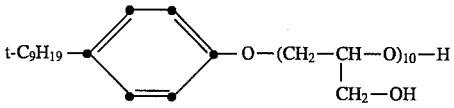
(S-8)
$n\text{-}C_{12}H_{25}-O-(CH_2-CH_2-O)_4-SO_3^-Na^+$ (S-9)
$n\text{-}C_{12}H_{25}-O-(CH_2-CH_2-O)_{12}-SO_3^-Na^+$ (S-10)
$n\text{-}C_{11}H_{25}-C(=O)-O-(CH_2-CH(CH_2OH)-O)_{10}-H$ (S-11)
$n\text{-}CH_3-(CH_2)_{14}-C(=O)-O-(CH_2-CH(CH_2OH)-O)_{10}-H$ (S-12)
$n\text{-}CH_3-(CH_2)_{14}-C(=O)-O-(CH_2-CH(CH_2OH)-O)_{6}-H$ (S-13)
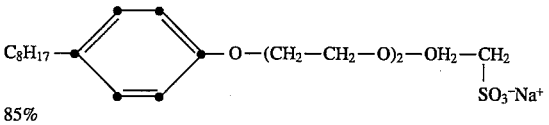
(S-14)
85%
and
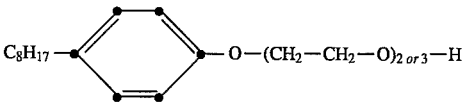
15%
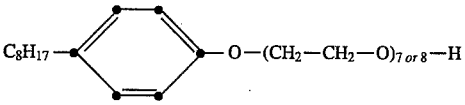
(S-15)
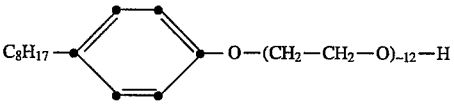
(S-16)
$n\text{-}C_{12}H_{25}-O-(CH_2-CH_2-O)_{\sim 8}-H$ (S-17)
$n\text{-}C_{12}H_{25}-O-(CH_2-CH-O)_{\sim 12}-H$ (S-18)
$n\text{-}C_{12}H_{25}-O-(CH_2-CH-O)_{\sim 23}-H$ (S-19)
$n\text{-}C_{12}H_{25}-O-(CH_2-CH_2-O)_4-CH_2-CH(SO_3^-Na^+)$ (S-20)
$n\text{-}C_{12}H_{25}-O-(CH_2-CH_2-O)_7-CH_2-CH(SO_3^-Na^+)$ (S-21)
$C_{12}H_{25}-O-(CH_2-CH_2-O)_{15}-CH_2-CH(SO_3^-Na^+)$ (S-22)
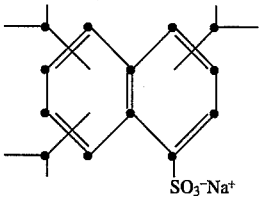
(S-23)

-continued

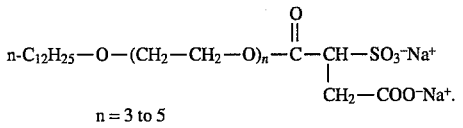

n = 3 to 5

9. A multilayer photographic element comprising a yellow layer formed of small particle microprecipitated dispersions, gelatin, at least one Type B preparation surfactant wherein Type B is a surfactant whose hydrophobic segment is composed of an aliphatic or aromatic hydrocarbon moiety composed of between 6 to 22 carbon atoms and a hydrophilic segment comprising between 2 to 20 oxyethylene or glycedylether groups with or without termination by a sulfate or a sulfonate group, and at least one of the sugar surfactants;

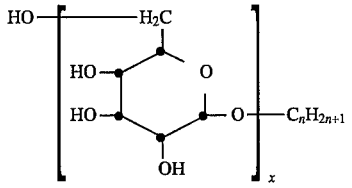

(S-24)

-continued or

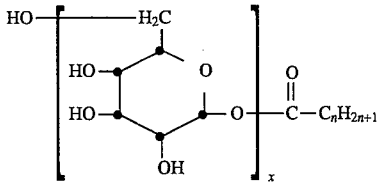

wherein n=5 to 20 and x=1 to 4 and a magneta layer comprising a trichlorophenyl pyrazolone magneta dye-forming coupler.

10. The element of claim 9 wherein said magneta coupler comprises

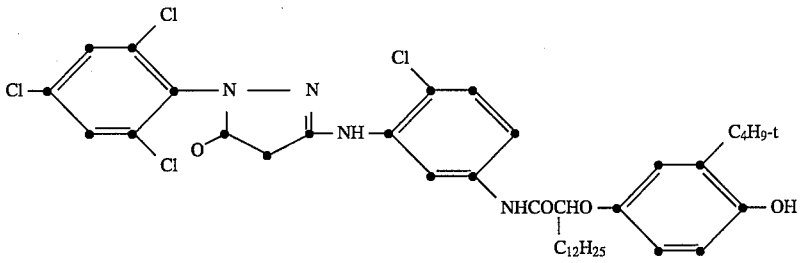

11. The multilayer photographic element of claim 9 wherein said small particle dispersion comprises particles comprising the yellow dye-forming coupler

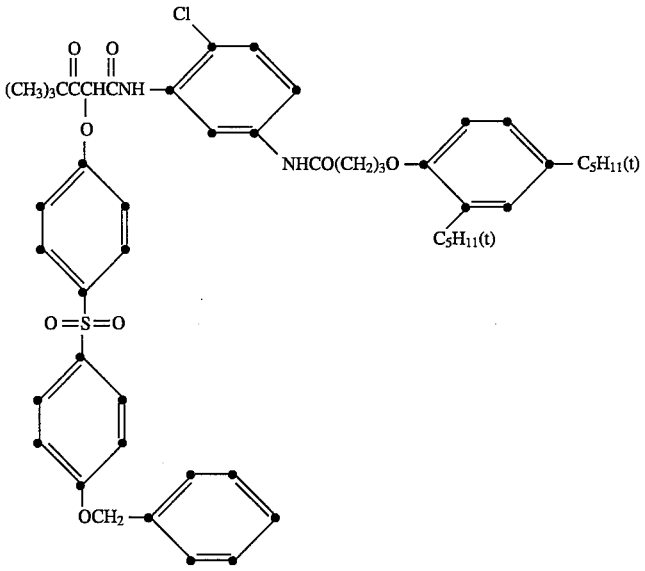

12. The multilayer photographic element of claim 9, wherein the small particle microprecipitated dispersion particle diameter is less than 100 nm.

13. The multilayer photographic element of claim 9, wherein the small particle microprecipitated dispersion particle diameter is less than 20 nm.

14. The multilayer photographic element of claim 9 wherein said sugar surfactant is present at levels between 0.1 to 0.3 g of surfactant per g of coupler.

15. The multilayer photographic element of claim 9 wherein the micoprecipitated dispersion comprises at least one of the following surfactants:

$CH_3-(CH_2)_{11}-OSO_3^-Na^+$ (S-1)

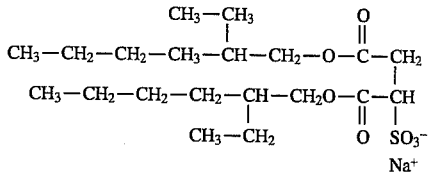
(S-2)

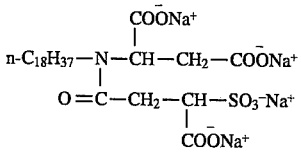
(S-3)

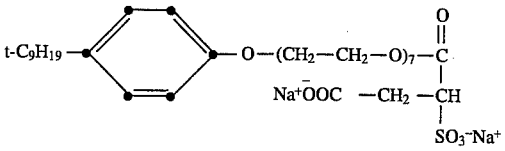
(S-4)

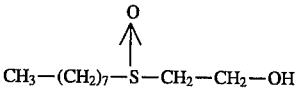
(S-5)

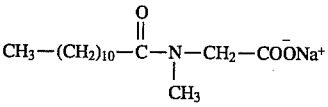
(S-6)

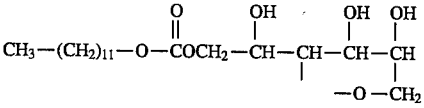
(S-7)

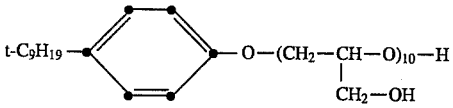
(S-8)

$n\text{-}C_{12}H_{25}-O-(CH_2-CH_2-O)_4-SO_3^-Na^+$ (S-9)

$n\text{-}C_{12}H_{25}-O-(CH_2-CH_2-O)_{12}-SO_3^-Na^+$ (S-10)

$n\text{-}C_{11}H_{25}-\underset{\underset{O}{\|}}{C}-O-(CH_2-\underset{\underset{CH_2OH}{|}}{CH}-O)_{10}-H$ (S-11)

$n\text{-}CH_3-(CH_2)_{14}-\underset{\underset{O}{\|}}{C}-O-(CH_2-\underset{\underset{CH_2OH}{|}}{CH}-O)_{10}-H$ (S-12)

$n\text{-}CH_3-(CH_2)_{14}-\underset{\underset{O}{\|}}{C}-O-(CH_2-\underset{\underset{CH_2OH}{|}}{CH}-O)_{6}-H$ (S-13)

-continued
(S-14)
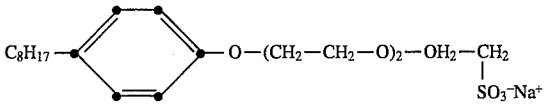
85%
and
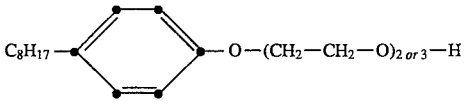
15%
(S-15)
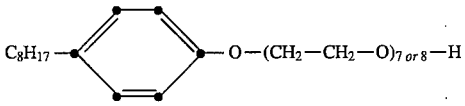
(S-16)
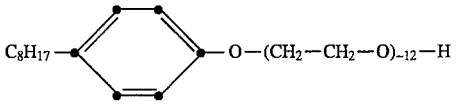
(S-17) $n\text{-}C_{12}H_{25}-O-(CH_2-CH_2-O)_{-8}-H$
(S-18) $n\text{-}C_{12}H_{25}-O-(CH_2-CH-O)_{-12}-H$
(S-19) $n\text{-}C_{12}H_{25}-O-(CH_2-CH-O)_{-23}-H$
(S-20) $n\text{-}C_{12}H_{25}-O-(CH_2-CH_2-O)_4-CH_2-\underset{\underset{SO_3^-Na^+}{|}}{CH}$
(S-21) $n\text{-}C_{12}H_{25}-O-(CH_2-CH_2-O)_7-CH_2-\underset{\underset{SO_3^-Na^+}{|}}{CH}$
(S-22) $C_{12}H_{25}-O-(CH_2-CH_2-O)_{15}-CH_2-\underset{\underset{SO_3^-Na^+}{|}}{CH}$
(S-23)
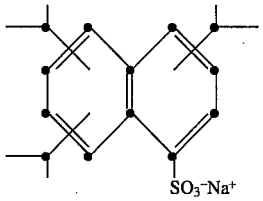
(S-24) $n\text{-}C_{12}H_{25}-O-(CH_2-CH_2-O)_n-\overset{\overset{O}{||}}{C}-\underset{\underset{CH_2-COO^-Na^+}{|}}{CH}-SO_3^-Na^+$.
n = 3 to 5
* * * * *